US006832058B2

(12) United States Patent
Akita et al.

(10) Patent No.: US 6,832,058 B2
(45) Date of Patent: Dec. 14, 2004

(54) IMAGE FORMING APPARATUS INCLUDING A MAXIMUM CHARGE QUANTITY OF TONER PARTICLES FORMING USELESS TONER

(75) Inventors: Hiroshi Akita, Hachioji (JP); Kunio Shigeta, Hachioji (JP); Takenobu Kimura, Hachioji (JP); Yotaro Sato, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/316,438

(22) Filed: Dec. 11, 2002

(65) Prior Publication Data

US 2003/0118362 A1 Jun. 26, 2003

(30) Foreign Application Priority Data

Dec. 20, 2001 (JP) ..... 2001-387456
Sep. 27, 2002 (JP) ..... 2002-283731

(51) Int. Cl.[7] ..... G03G 15/00; G03G 15/043; G03G 15/06; G03G 21/00

(52) U.S. Cl. ..... 399/51; 399/55; 399/129

(58) Field of Search ..... 399/51, 53, 55, 399/222, 302, 308, 128, 129; 430/120, 110.4, 111.4

(56) References Cited

U.S. PATENT DOCUMENTS 4,844,008 A * 7/1989 Sakemi et al. ..... 399/270
5,862,432 A * 1/1999 Nakayama et al. ..... 399/129 X
6,405,002 B2 * 6/2002 Ogiyama et al. ..... 399/302 X

FOREIGN PATENT DOCUMENTS

JP 05-002287 * 1/1993
JP 2000-081722 A 3/2000
JP 2001-005208 A 1/2001

* cited by examiner

*Primary Examiner*—Sophia S. Chen
(74) *Attorney, Agent, or Firm*—Frishauf, Holtz, Goodman & Chick, P.C.

(57) ABSTRACT

In an image forming apparatus, an electrostatic latent image is reverse-developed by a developing device with a development bias applied, through conveying a two-component developer layer containing toner particles having a volume-average particle diameter of 3 to 5 $\mu$m by a developer carrying member rotatably provided, a developed toner image is transferred onto a recording medium or an intermediate transfer body, and untransferred toner particles remaining on an image forming body having passed a transfer region are removed by a cleaning member provided in pressure contact with the surface of the image forming body. The length in an axis direction of the image forming body of an useless toner image formed on the image forming body at the starting time and the ending time of an image formation sequence denoted by L, the total charge quantity of the toner particles making up the useless toner image is 0.04L $\mu$C or less.

17 Claims, 6 Drawing Sheets

IMAGE FORMING APPARATUS INCLUDING A MAXIMUM CHARGE QUANTITY OF TONER PARTICLES FORMING USELESS TONER

BACKGROUND OF THE INVENTION

This invention relates to an image forming apparatus utilizing an electrophotographic method such as, for example, a copying machine, a printer, and a facsimile machine.

At present, as regards an image forming apparatus of a certain kind utilizing an electrophotographic method, it is widely utilized an image forming apparatus of a reverse development type in which the surface of a drum-shaped photoreceptor which is an image forming member and is driven to rotate is charged to the specified polarity (negative, for example) by a charging means consisting of a charging device using, for example, corona discharge, an electrostatic latent image is formed by exposing the surface of this photoreceptor image-wise to an image exposure means using, for example, a laser optical system, and the electrostatic latent image is visualized through the toner deposition on the image-wise exposed area of the photoreceptor by a developing means using a two-component developer composed of toner particles which have been triboelectrically charged to the same polarity as the surface potential of the photoreceptor (negative, for example) and carrier particles (positively charged). In this case, in making toner particles adhere to the image-wise exposed area of the photoreceptor, a development bias voltage of the same polarity as the surface potential of the photoreceptor (negative polarity, for example) is applied to a developing roller (developer carrying member) which makes up a developing means and is arranged opposite to the photoreceptor with the developing region positioned in between.

When an image formation sequence is started by means of such an image forming apparatus, problems of various kinds are produced in some cases, depending on the relationship between the start timing of the application of the charging voltage and the start timing of the application of the development bias voltage. In the following, such problems will be explained with reference to FIG. 5 and FIG. 6.

For example, as shown in FIG. 5, for the non-print area of the photoreceptor from which no toner image is to be transferred to an image recording medium such as a transfer paper sheet (hereinafter referred to as a recording medium simply) which is positioned, with respect to the rotating direction of the photoreceptor, at the downstream side of the print area of the photoreceptor from which a toner image is to be transferred to the recording medium, in the case where a condition is set in such a way that the development bias application region (Ra) to which a development bias voltage is to be applied substantially coincides with the region where the surface potential of the charged photoreceptor is raised to a specified potential value (Rb), to state it concretely, in the case where a condition is set so as to make the start point on the photoreceptor of the application of the charging voltage (Pb1) come to a more downstream position than the start point on the photoreceptor of the application of the developing bias voltage (Pa1), a "carrier adhering" phenomenon, in which carrier particles in the developer carried on the developing sleeve adheres on the surface of the photoreceptor, is produced in the region between a place located in the charging voltage application region facing the charging means at the starting time of the application of the charging voltage (Pb1) (for example, the place which is located at the downmost stream position with respect to the rotating direction of the photoreceptor in the charging voltage application region (i), refer to FIG. 1), and the place where the surface potential has the same potential value as the development bias voltage (Vd) at the rising time of the surface potential (the place which is located in the developing region P at the starting time of the application of the development bias voltage (Pa1) (ii)). In this case, compared to the rise characteristic at the time of application of the development bias voltage shown by the wave form (A) in FIG. 5 being sharp, the rise characteristic of the charge potential of the photoreceptor at the time of the application of the charging voltage is more gentle; therefore, by the setting of a condition to make the start point of the application of the charging voltage (Pb1) more downstream than the start point of the application of the development bias voltage (Pa1), it is obtained a state in which the development bias application region (Ra), which means the region being subjected to the application of the development bias voltage, comes to substantially coincide with the region where the charge potential has the specified potential value (Rb).

Further, also at the ending time of an image formation sequence, in the case where the stop point on the photoreceptor of the application of the charging voltage (Pb2) is determined to be more upstream than the stop point on the photoreceptor of the application of the development bias voltage (Pa2), a "carrier adhering" phenomenon, in which carrier particles in the developer carried on the developing sleeve adhere on the photoreceptor surface, is produced in the region between the place where the surface potential of the charged photoreceptor has the same potential value as the development bias voltage (Vd), which is lower than the specified surface potential (Vh) at the falling time of the surface potential (the place which is located at the developing region P at the stopping time of the development bias voltage (Pa2)), and the place which is located at the developing region P at the stopping time of the application of the charging voltage (Pb2).

On the other hand, for example, as shown in FIG. 6, in the case where, in order that the development bias voltage may be applied even to the region where the surface potential of the charged photoreceptor has not been raised to the specified potential value, when an image formation sequence is started, the application region of the development bias voltage (Ra) is determined to be larger than the region (Rb) where the surface potential of the charged photoreceptor is kept at the specified potential state, to state it concretely, in the case where the start point on the photoreceptor of the application of the charging voltage (Pb1) is determined to substantially coincide with the start point on the photoreceptor of the application of the development bias voltage (Pa1), toner particles in the developer carried on the developing sleeve adhere on the surface of the photoreceptor to form, for example, an unnecessary stripe-shaped toner image on the photoreceptor, in the region where the potential difference between the surface potential and the development bias voltage is large between a place which is located in the charging voltage application region at the starting time of the application of the charging voltage (Pb1) (for example, the place which is located at the downmost stream position with respect to the rotating direction of the photoreceptor in the charging voltage application region (i)), and the place where the surface potential of the charged photoreceptor has been raised to the same value as the development bias voltage (Vd) at its rising time (ii).

Further, also at the ending time of an image formation sequence, in the case where the stop point on the photoreceptor of the application of the charging voltage (Pa2) is determined to substantially coincide with the stop point on the photoreceptor of the development bias voltage (Pb2), toner particles in the developer carried on the developing sleeve adhere on the surface of the photoreceptor to form, for example, an unnecessary stripe-shaped toner image on the photoreceptor in the region where the difference between the surface potential and the development bias voltage is large between the place where the surface potential of the charged photoreceptor has the same potential value as the development bias voltage (Vd), which is lower than the specified potential value (Vh), at its falling time, and the place which is located at the developing region P at the stopping time of the application of the development bias voltage (Pa2).

In the above, the reason that the rise characteristic and the fall characteristic of the surface potential of the charged photoreceptor at the starting time and the stopping time of the charging voltage are gentle (gently-sloping) is that, in contrast with the development bias voltage acting in the narrow developing region (development nip), the charging voltage acts on the photoreceptor with a broad width of a certain degree as is observed in the example of a corona discharge electrode; hence, the rise characteristic or the fall characteristic of the surface potential on the charged photoreceptor becomes more gentle than the rise characteristic or the fall characteristic of the charging power source itself.

Therefore, in a conventional image forming apparatus, for the reason that a damage tends to be produced on the surface of the photoreceptor if carrier adhering is produced, which lowers the characteristics of the photoreceptor itself, it is made a setting such that image forming operation is practiced under an operational condition to positively form an useless toner image (refer to FIG. 6), and it is put into practice to remove the toner image which is inevitably formed on the photoreceptor in order to prevent the occurrence of carrier adhering by an image forming member cleaning means. For the image forming member cleaning means, it can be cited a blade cleaning method in which toner particles remaining on the photoreceptor are removed by, for example, a cleaning blade being provided in a state of pressing contact with the surface of the photoreceptor and rubbing the surface of the photoreceptor.

However, in the case where an image formation operation is carried out in a state controlled in this way, the cleaning member in the image forming member cleaning means comes to have an excessive load, and as the result of it, it is raised a problem that it becomes impossible to remove toner particles remaining on the photoreceptor with certainty which makes it difficult to form a high-quality image after all.

On the other hand, in recent years, as regards an image forming apparatus as described in the above, a requirement for making it of a high image quality is strong, and in order to form an image having the same image quality as that of an image formed by offset printing, for example, it has been put into practice to make toner particles composing a toner have a small diameter (for example, refer to the publications of the unexamined patent application 2000-81722 and 2001-5208). Especially, by the use of a toner which is composed of toner particles having small particle diameter and has a sharp particle size distribution, the packing density of the toner particles in the toner layer is made higher and the vacant space is reduced, which gives a high-quality image.

However, accompanied by the toner particles being made to have a smaller particle diameter, the adhering force between the toner particles and the photoreceptor becomes larger; as the result, it becomes extremely difficult to remove untransferred toner particles including the residual toner particles after transfer on the photoreceptor, and the occurrence of a poor-cleaning phenomenon of what is called "slipping-through" (also referred to as "insufficient toner removal") becomes remarkable.

Especially, in the case where an image formation operation is carried out in an environment of a low temperature and a low humidity, a phenomenon of unsatisfactory cleaning such as the slipping-through of toner particles appears remarkably.

A phenomenon as described in the above is produced not only at the starting time of an image formation sequence but also at the ending time of an image formation sequence.

SUMMARY OF THE INVENTION

This invention has been made on the basis of the above-mentioned situation, and its object is to provide an image forming apparatus which is capable of exhibiting a high cleaning effect with certainty by a cleaning means over a long period of time, and hence, is capable of forming an image of a high image quality.

The object of this invention can be accomplished by the adopting of any one of the structures (1) to (17) shown below.

(1) An image forming apparatus comprising an image forming member to be rotated, a charging means for charging the surface of the image forming member, an exposure means for exposing the surface of the image forming member to light to form an electrostatic latent image, a developing means for reverse-developing the electrostatic latent image through conveying a layer of two-component developer containing toner particles having a volume-average particle diameter of 3 $\mu$m to 5 $\mu$m by a developer carrying member provided rotatably opposite to the image forming member with the developing region positioned in between with a development bias applied, a transfer means for transferring a toner image formed on the image forming member onto a recording medium or onto an intermediate transfer member in a transfer region, and a cleaning means for removing untransferred toner particles remaining on the image forming member having passed the transfer region by a cleaning member provided in pressing contact with the surface of the image forming member, characterized in that, with the length in the lengthwise direction of an useless toner image formed on the image forming member at the starting time and the ending time of an image formation sequence denoted by L, the total charge quantity of the toner particles making up the useless toner image is 0.04L $\mu$C or less.

(2) An image forming apparatus comprising an image forming member to be rotated, a charging means for charging the surface of the image forming member, an exposure means for exposing the surface of the image forming member to light to form an electrostatic latent image, a developing means for reverse-developing the electrostatic latent image through conveying a layer of two-component developer containing toner particles having a volume-average particle diameter of 3 $\mu$m to 5 $\mu$m by a developer carrying member provided rotatably opposite to the image forming member with the developing region positioned in between with a development bias applied, a transfer means for transferring a toner image formed on the image forming member onto a recording medium or onto an intermediate transfer member in a transfer region, and an image forming member cleaning means for removing untransferred toner particles remaining on the image forming member having passed the transfer region by a cleaning member provided in pressing contact with the surface of the image forming member, characterized in that, at the starting time of the image formation sequence, a specified exposure processing is carried out in which exposure by the exposure means is started at the timing when the place on the image forming member located at the downmost stream position with respect to the rotating direction of the image forming member in the charging voltage application region on the image forming member facing the charging means at the starting time of the application of the charging voltage by the charging means reaches the exposure position by the exposure means, or before the place reaches the exposure position, and exposure by the exposure means is stopped at the timing when the place on the image forming member located at the uppermost stream position in the charging voltage application region at the starting time of the charging voltage application reaches the exposure position or after the place has passed the exposure position, further, a development bias voltage is applied to the developer carrying member at the timing when the place on the photoreceptor located at the exposure position at the stopping time of the exposure in the specified exposure processing reaches the developing region or before the place reaches the developing region, and with the length in the lengthwise direction of an useless toner image formed on the image forming member denoted by L, the total charge quantity of the toner particles making up the useless toner image is 0.04L $\mu$C or less.

(3) An image forming apparatus as set forth in the structure (2) characterized in that the start of the application of the development bias voltage to the developer carrying member is carried out during a period of time before the timing when the place on the image forming member which is located at the exposure position at the exposure stopping time in the specified exposure processing reaches the developing region and after the timing when the place located at the 15 mm downstream position of the place with respect to the rotating direction of the image forming member reaches the developing region.

(4) An image forming apparatus as set forth in the structure (2) or (3) characterized by the total quantity of the toner particles forming the stripe-shaped useless toner image formed on the image forming member being made 25 mg or less.

(5) An image forming apparatus as set forth in any one of the structures (2) to (4) characterized in that the stopping of the exposure in the specified exposure processing is carried out, between the timing when the first place on the image forming member located at the uppermost stream position in the charging voltage application region at the starting time of the charging voltage application reaches the exposure position, and the timing when the second place located, with respect to the moving direction of the image forming member, at the 20 mm or more downstream position of the leading edge position of the beginning image region located at the upstream side of the first place with respect to the rotating direction of the image forming member reaches the exposure position.

(6) An image forming apparatus as set forth in any one of the structures (1) to (5) characterized by the toner particles removed from the image forming member by the image forming member cleaning means being utilized again.

(7) An image forming apparatus comprising an image forming member to be rotated, a charging means for charging the surface of the image forming member, an exposure means for exposing the surface of the image forming member to light to form an electrostatic latent image, a developing means for reverse-developing the electrostatic latent image through conveying a layer of two-component developer containing toner particles having a volume-average particle diameter of 3 $\mu$m to 5 $\mu$m by a developer carrying member provided rotatably opposite to the image forming member with the developing region positioned in between with a development bias applied, a transfer means for transferring a toner image formed on the image forming member onto a recording medium or onto an intermediate transfer member in a transfer region, and an image forming member cleaning means for removing untransferred toner particles remaining on the image forming member having passed the transfer region by a cleaning member provided in contact with the surface of the image forming member, characterized in that, at the ending time of the image formation sequence, a specified exposure processing is carried out in which exposure by the exposure means is started at the timing when the place located at the downmost stream position with respect to the rotating direction of the image forming member in the charging voltage application region on the image forming member facing the charging means at the stopping time of the application of the charging voltage by the charging means reaches the exposure position by the exposure means, or before the place reaches the exposure position, and exposure by the exposure means is stopped at the timing when the place on the image forming member located at the uppermost stream position in the charging voltage application region at the stopping time of the charging voltage application reaches the exposure position or after the place has passed the exposure position, further, the application of a development bias voltage to the developer carrying member is stopped at the timing when the place on the image forming member located at the exposure position at the starting time of the exposure in the specified exposure processing reaches the developing region or after the place has passed the developing region, and with the length in the lengthwise direction of an useless toner image formed on the image forming member denoted by L, the total charge quantity of the toner particles making up the useless toner image is made 0.04L $\mu$C or less.

(8) An image forming apparatus as set forth in the structure (7), characterized in that the stop of the application of the development bias voltage to the developer carrying member is carried out between the timing when the place on the image forming member located at the exposure position at the exposure starting time in the specified exposure processing reaches the developing region and the timing when the point located at the 15 mm upstream position of the place with respect to the rotating direction of the image forming member reaches the developing region.

(9) An image forming apparatus as set forth in the structure (7) or (8), characterized by the total quantity of toner forming the stripe-shaped useless toner image formed on the image forming member being made 25 mg or less.

(10) An image forming apparatus as set forth in any one of the structures (7) to (9), characterized in that the exposure starting in the specified exposure processing is carried out between the timing when the place located, with respect to the moving direction of the image forming member, at the 20 mm or more upstream position of the trailing edge position of the last image area reaches the exposure position and the timing when the place on the image forming member located at the downmost stream position in the charging voltage application region at the stopping time of the charging voltage application reaches the exposure position.

(11) An image forming apparatus as set forth in any one of the structures (7) to (10), characterized by the toner particles removed from on the image forming member by the image forming member cleaning means being utilized again.

(12) An image forming apparatus comprising an image forming member to be rotated, a charging means for charging the surface of the image forming member, an exposure means for exposing the surface of the image forming member to light to form an electrostatic latent image, a developing means for reverse-developing the electrostatic latent image through conveying a layer of two-component developer containing toner particles having a volume-average particle diameter of 3 $\mu$m to 5 $\mu$m by a developer carrying member provided rotatably opposite to the image forming member with the developing region positioned in between with a development bias applied, a transfer means for transferring a toner image formed on the image forming member onto a recording medium or onto an intermediate transfer member in a transfer region, and an image forming member cleaning means for removing untransferred toner particles remaining on the image forming member having passed the transfer region by a cleaning member provided in pressing contact with the surface of the image forming member, wherein at the starting time and the ending time of the image formation sequence, a development bias voltage is made to act on the deficiently charged areas of the image forming member, while the peripheral speed of the developer carrying member is controlled, characterized in that, at least at one of the starting time and the ending time of the image formation sequence, in the deficiently charged area on the image forming member passing the developing region with a development bias voltage made to act on it, the peripheral speed of the developer carrying member is controlled in such a way that the maximum development toner quantity is reduced from the set maximum development toner quantity to be supplied for the development of the electrostatic latent image to become 0.3 mg/cm$^2$ or less, and with the length in the lengthwise direction of a useless toner image formed in the deficiently charged area on the image forming member denoted by L, the total charge quantity of the toner particles making up the useless toner image is made 0.04L $\mu$C or less.

(13) An image forming apparatus comprising a toner image forming unit provided with an image forming member to be rotated, made up of a charging means for charging the image forming member, an exposure means for exposing the image forming member to light to form an electrostatic latent image, and a developing means for reverse-developing the electrostatic latent image to form a toner image through conveying a layer of two-component developer containing toner particles having a volume-average particle diameter of 3 $\mu$m to 5 $\mu$m by a developer carrying member provided rotatably opposite to the image forming member with the developing region positioned in between with a development bias applied, arranged in the order of operation with respect to the rotating direction of the image forming member in the outer circumferential region of the image forming member, a primary transfer means for forming a primary transfer toner image through transferring the toner image formed on the image forming member onto an intermediate transfer member in a primary transfer region, a secondary transfer means for forming a secondary transfer toner image through transferring the primary transfer toner image formed on the intermediate transfer member onto an image recording medium in a secondary transfer region, an image forming member cleaning means for removing untransferred toner particles remaining on the image forming member having passed the primary transfer region by a cleaning member provided in pressing contact with the surface of the image forming member, and an intermediate transfer member cleaning means for removing untransferred toner particles remaining on the intermediate transfer member having passed the secondary transfer region by a cleaning member provided in pressing contact with the surface of the intermediate transfer member, wherein at the starting time and the ending time of an image formation sequence, a development bias voltage is made to act on the deficiently charged areas on the image forming member, characterized in that at least at one of the starting time and the ending time of an image formation sequence, a part or the whole of the toner particles making up a useless toner image formed in the deficiently charged area on the image forming member passing the developing region with a development bias voltage made to act on it are transferred to the intermediate transfer member, to be removed from on the intermediate transfer member, and with the length in the lengthwise direction of a toner image formed in the deficiently charged area on the image forming member denoted by L, the total charge quantity of the toner particles making up the useless toner image is made 0.04L $\mu$C or less.

(14) An image forming apparatus comprising an image forming member to be rotated, a charging means for charging the surface of the image forming member, an exposure means for exposing the surface of the image forming member to light to form an electrostatic latent image, a developing means for reverse-developing the electrostatic latent image to form a toner image through conveying a layer of two-component developer containing toner particles having a volume-average particle diameter of 3 $\mu$m to 5 $\mu$m by a developer carrying member provided rotatably opposite to the image forming member with the developing region positioned in between with a development bias applied, a transfer means for transferring a toner image formed on the image forming member onto a recording medium or onto an intermediate transfer member in a transfer region, and an image forming member cleaning means for removing untransferred toner particles remaining on the image forming member having passed the transfer region by a cleaning member provided in pressing contact with the surface of the image forming member, wherein at the starting time and the ending time of an image formation sequence, a development bias voltage is made to act on the deficiently charged areas of the image forming member, characterized in that a toner charge quantity reducing means for reducing the charge quantity of undeveloped toner particles on the image forming member by the application of an alternate-current discharging voltage is provided at an upstream position of the cleaning region by the image forming member cleaning means with respect to the rotating direction of the image forming member, at least at one of the starting time and the ending time of an image formation sequence, on the deficiently charged area of the image forming member passing the developing region with a development bias voltage made to act on it, an electric field for charge elimination is made to act, to make the total charge quantity of the toner particles making up a useless toner image formed on the deficiently charged area of the image forming member 0.04L $\mu$C or less, where the length in the lengthwise direction of the useless toner image is denoted by L.

(15) An image forming apparatus as set forth in the structure (14) characterized by the toner charge quantity reducing means reducing the absolute value of the average charge quantity of the untransferred toner particles on the image forming member to 35 $\mu$C/g or less.

(16) An image forming apparatus comprising an image forming member to be rotated, a charging means for charging the surface of the image forming member, an exposure means for exposing the surface of the image forming member to light to form an electrostatic latent image, a developing means for reverse-developing the electrostatic latent image to form a toner image through conveying a layer of two-component developer containing toner particles having a volume-average particle diameter of 3 μm to 5 μm by a developer carrying member provided rotatably opposite to the image forming member with the developing region positioned in between with a development bias applied, a transfer means for transferring a toner image formed on the image forming member onto a recording medium or onto an intermediate transfer member in a transfer region, and an image forming member cleaning means for removing untransferred toner particles remaining on the image forming member having passed the transfer region by a cleaning member provided in pressing contact with the surface of the image forming member, wherein at the starting time and the ending time of an image formation sequence, a development bias voltage is made to act on the deficiently charged areas of the image forming member, characterized in that a toner charge quantity reducing means for reducing the charge quantity of undeveloped toner particles on the image forming member by the application of a direct-current discharging voltage of the polarity reverse to the charge polarity of the toner is provided, with respect to the rotating direction of the image forming member, at an upstream position of the cleaning region by the image forming member cleaning means, and at least at one of the starting time and the ending time of an image formation sequence, on the deficiently charged area of the image forming member passing the developing region with a development bias voltage made to act on it, an electric field for charge elimination is made to act, to make the total charge quantity of the toner particles making up a useless toner image formed on the deficiently charged area of the image forming member 0.04L μC or less, where the length in the lengthwise direction of the useless toner image is denoted by L.

(17) An image forming apparatus as set forth in the structure (16) characterized by the toner charge quantity reducing means reducing the absolute value of the average charge quantity of the untransferred toner particles on the image forming member to 35 μC/g or less.

By an image forming apparatus having the above-mentioned structure, the load given to the cleaning member in the image forming member cleaning means is reduced by a large margin by making it 0.04L (μC) or less the total charge quantity of the toner particles making up a useless toner image, which is formed inevitably for the image forming member positively for the purpose of preventing the occurrence of carrier adhering to the image forming member at the starting time and the ending time of the image formation sequence; therefore, the expected cleaning effect can be exhibited with certainty and the untransferred toner particles remaining on the image forming member can be removed with certainty; hence, an image having a high image quality can be obtained with certainty.

By the specified exposure processing being carried out when an image formation sequence is started, in which image forming member is exposed to light before the application of the charging voltage, and the exposure by the exposure means is stopped immediately after the starting time of the application of the development bias voltage, compared to the useless toner image which is formed in the case where it is set a state that the start timing of the charging voltage application is made to approximately coincide with the start timing of the development bias voltage, the width of the useless toner image can be made as small as possible; owing to this, it can be actualized with certainty a state that the total charge quantity of the toner particles making up the useless toner image becomes 0.04L (μC) or less.

Further, by the specified exposure processing being carried out when an image formation sequence is finished, in which the image forming member is exposed to light before the application of the development bias voltage is stopped and the exposure by the exposure means is stopped immediately after the charge potential of the image forming member is reduced to zero, compared to the useless toner image which is formed in the case where it is set a state that the start timing of the charging voltage application is made to approximately coincide with the start timing of the development bias voltage, the width of the useless toner image can be made as small as possible; owing to this, it can be actualized with certainty a state that the total charge quantity of the toner particles making up the useless toner image becomes 0.04L (μC) or less.

Further, because the quantity of the toner making up the useless toner image formed on the deficiently charged region of the image forming member can be made to have a small value equal to or less than a definite value by it that, at least at one of the starting time and the ending time of an image formation sequence, when the deficiently charged region on the image forming member passes the developing region, the maximum development toner quantity is reduced by a specified decrement to become the specified quantity from the maximum development toner quantity during the development of the print area, it can be actualized with certainty a state that the total charge quantity of the toner particles making up the useless toner image becomes 0.04L (μC) or less.

Further, because the quantity of the toner making up the useless toner image formed in the deficiently charged region of the image forming member can be made to have a small value equal to or less than a definite value by it that, under the condition that is set in such a manner that, at least at one of the starting time and the ending time of an image formation sequence, a useless toner image is positively formed on the image forming member for the purpose of preventing the occurrence of carrier adhering to the image forming member, a part or the whole of the toner particles making up the useless toner image formed on the deficiently charged area on the image forming member are transferred onto the intermediate transfer member, it can be actualized with certainty a state that the total charge quantity of the toner particles making up the useless toner image becomes 0.04L (μC) or less.

Further, it can be actualized with certainty a state that the total charge quantity of the toner particles making up the useless toner image becomes 0.04L (μC) or less by it that, at least at one of the starting time and the ending time of an image formation sequence, on the deficiently charged area on the image forming member, an electric field for eliminating charge is made to act, by the toner charge quantity reducing means to which an alternate-current discharging voltage or a direct-current discharging voltage of the polarity reverse to the charge polarity of the toner, to reduce the charge quantity of the toner making up the useless toner image.

DETAILED DESCRIPTION OF THE PREFERRED EMBODIMENT

In the following, this invention will be explained with reference to the drawings.

<First Embodiment>

Figure 1:
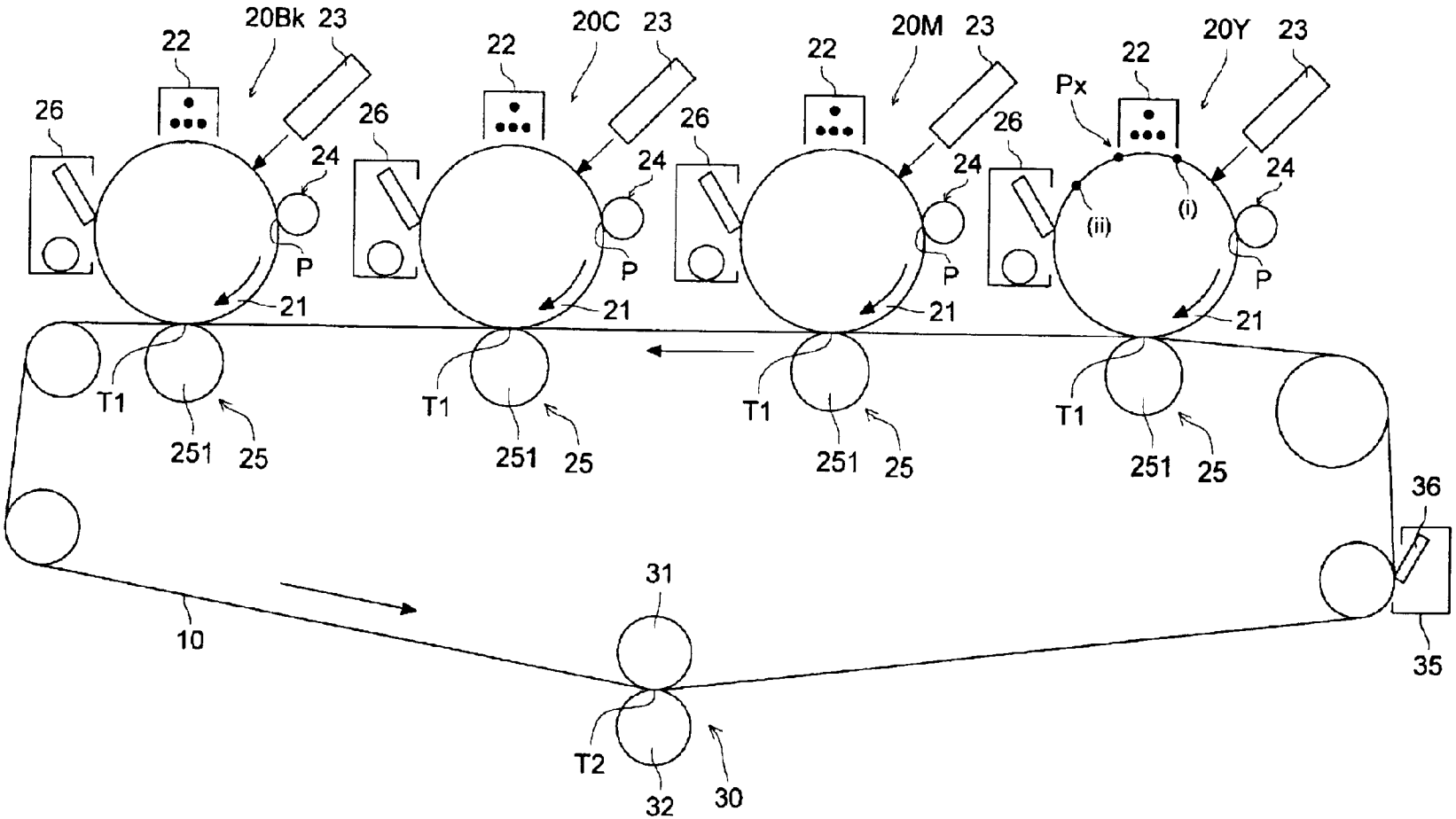
FIG. 1 is an illustrative drawing showing the outline of the structure of an example of an image forming apparatus of this invention.
Figure 2:
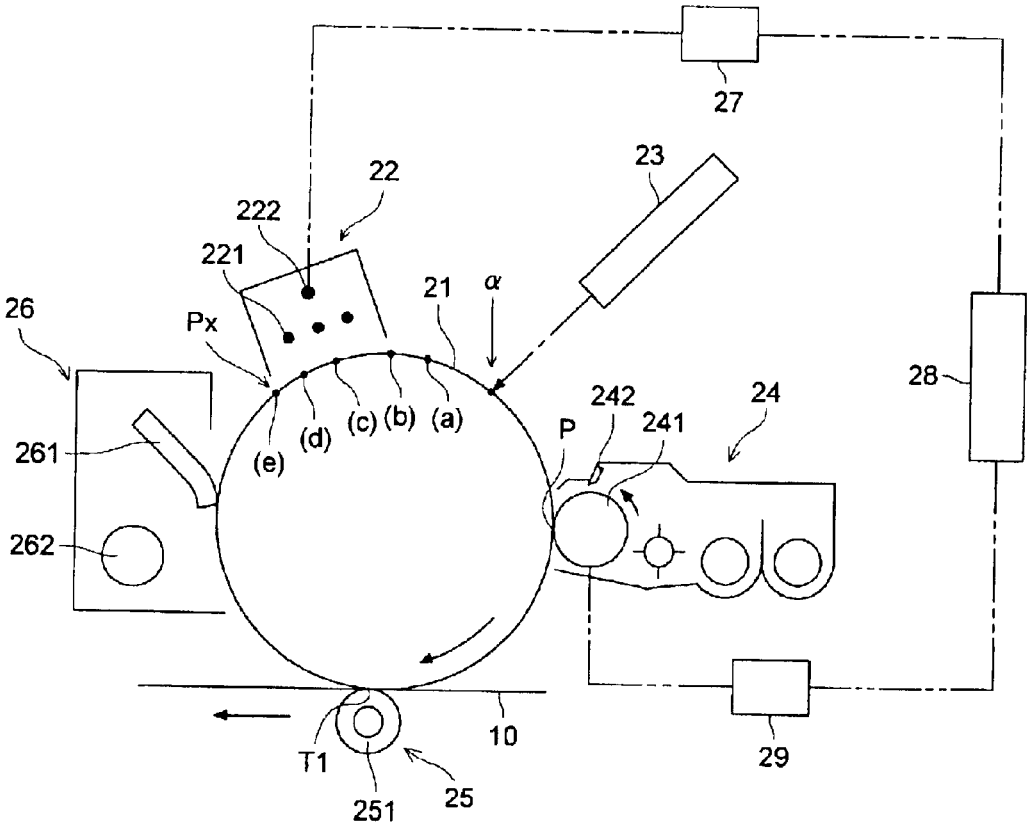
FIG. 2 is an illustrative drawing showing the structure of the toner image forming unit of the image forming apparatus shown in FIG. 1.

FIG. 1 is an illustrative drawing showing the outline of the structure of an example of an image forming apparatus of this invention, and FIG. 2 is an illustrative drawing showing the structure of the toner image forming unit of the image forming apparatus shown in FIG. 1.

An image forming apparatus of this example forms a color image through the steps of primarily transferring constituent color toner images formed by the respective 4 toner image forming units sequentially to the intermediate transfer member, to superpose the constituent color toner images on said intermediate transfer member, and secondarily transferring the composite color toner image having formed on it onto a recording medium.

To explain it concretely, this image forming apparatus is provided with an intermediate transfer member 10 having a shape of an endless belt (hereinafter referred to as an intermediate transfer belt) arranged as trained about a group of a plurality of support rollers, and along the outer circumferential surface of this intermediate transfer belt 10, toner image forming units 20Y, 20M, 20C, and 20Bk for the respective color toners, a yellow toner (Y), a magenta toner (M), a cyan toner (C), and a black toner (K), are provided in such a way that they are arrayed apart form one another in the above-mentioned order with respect to the moving direction of the intermediate transfer belt 10.

Each of the toner image forming units 20Y, 20M, 20C, and 20Bk is equipped with a drum-shaped photoreceptor 21 to be rotated as an image forming member, and each of the photoreceptors is made up of a charging means 22, an exposure means 23, a developing means 24, a primary transfer means 25, and a photoreceptor cleaning means 26 arranged in the order of operation with respect to the rotating direction of the photoreceptor 21.

The photoreceptor 21 in each of the toner image forming units 20Y, 20M, 20C, and 20Bk is made up of a photosensitive layer formed on the outer circumferential surface of a drum-shaped metallic base for example, and is arranged with its axis extending in the width direction of a recording medium such as a transfer paper for example (the direction perpendicular to the paper surface in FIG. 1).

As regards the kind of the photosensitive layer, it is not to be particularly limited; for example, an inorganic photosensitive layer composed of selenium, arsenic-selenium alloy, amorphous selenium (a—Se), cadmium sulfide CdS), zinc oxide (ZnO), amorphous silicon (a—Si), etc., an organic photosensitive layer composed of an organic photoconductive compound, etc. can be cited.

A desirable example of the first embodiment of the photoreceptor 21 is an organic photoreceptor formed of a photosensitive layer composed of a resin material containing an organic photoconductor, and it is particularly desirable an organic photoreceptor of a separate-function type composed of a charge transport layer and a charge generation layer superposed.

The charging means 22 in each of the toner image forming units 20Y, 20M, 20C, and 20Bk is made up of a scorotron charging device comprising, for example, a control grid 221 which is kept at a specified electric potential with respect to the photosensitive layer surface of the photoreceptor 21 and a corona discharge electrode 222 made up of a discharging wire for example, and is disposed opposite to the photoreceptor, extending in the direction of its rotational axis (the direction perpendicular to the paper surface in FIG. 1).

A power source 27 for applying an electric voltage to the corona discharge electrode 222 is connected to the charging means 22, and to this power source 27, a control means 28 for controlling the magnitude of voltage to be applied to the corona discharge electrode 222 is connected.

The exposure means 23 in each of the toner image forming unit 20Y, 20M, 20C, and 20Bk is made up of a light emitting device composed of a digital optical system for making a scanning exposure for the photoreceptor 21 through converting digitized image data into an optical signal, for example, a laser beam emitting device composed of a laser optical system; for example, a laser beam from a light source provided with a light emitting device of a laser diode (LD) irradiates the surface of the photoreceptor 21 through an optical system composed of a rotating polygonal mirror, an fθ lens, a cylindrical lens, etc.

The developing means 24 in each of the toner image forming units 20Y, 20M, 20C, and 20Bk is provided with a developing sleeve 241 which is a developer carrying member arranged opposite to the photoreceptor 21 with the developing region P positioned in between; to this developing sleeve 241, it is connected a power source 29 for applying a direct-current development bias voltage of the same polarity as the toners (negative polarity for example) or a development bias voltage composed of a direct-current voltage with an alternate-current voltage superposed.

On the surface of the developing sleeve 241, it is carried a layer of two-component developer composed of toner particles triboelectically charged in the same polarity as the surface potential of the photoreceptor 21 (negative polarity for example), and carrier particles triboelectically charged in the reverse polarity to the toner particles (positive polarity for example); said two-component developer layer is conveyed to the developing region P with the quantity of carried developer controlled by a developer regulating means 242 by the developing sleeve 241 being driven to rotate.

The maximum development width formed by the developing means 24 is determined to be smaller than the maximum exposure width formed by the above-mentioned exposure means 23 in the main scanning direction (the direction perpendicular to the rotating direction of the photoreceptor 21).

The primary transfer means 25 in each of the toner image forming units 20Y, 20M, 20C, and 20Bk has a structure such that a primary transfer roller 251 for transferring a toner image on the photoreceptor 21 onto the intermediate transfer belt 10 by a transfer electric field being formed by the application of a transfer bias voltage controlled to an appropriate magnitude is pressed to the photoreceptor 21 with the intermediate transfer belt 10 gripped in between to form a primary transfer region T1; the image forming apparatus has a structure such that, owing to the above-mentioned structure, the intermediate transfer belt 10 is moved cyclically while kept in contact with each of the photoreceptors 21.

The photoreceptor cleaning means 26 in each of the toner image forming units 20Y, 20M, 20C, and 20Bk is provided with a plate-shaped photoreceptor cleaning blade (cleaning member) 261 made of an elastic substance such as urethane rubber disposed as extending in the axial direction of the photoreceptor 21 with its front edge kept in pressing contact with the surface of the photoreceptor, and comprises a toner recycle mechanism for collecting the untransferred toner particles, which have been scraped off by the photoreceptor cleaning blade, by the collection roller 262 and conveying them to the developing means 24.

It is desirable that the pressing force of the photoreceptor cleaning blade 261 acting on the photoreceptor 21 is, for example, 0.001 N/cm to 0.30 N/cm (0.1 gf/cm to 30 gf/cm), and more desirably it should be 0.01 N/cm to 0.25 N/cm (1 gf/cm to 25 gf/cm). If the pressing force is smaller than 0.001 N/cm, the cleaning force is deficient, and if it is larger than 0.30 N/cm, the wear of the photoreceptor 21 becomes larger, which makes toner deposition on background area, scratches in the image tend to be produced.

As regards the measurement of the pressing force, a method of measurement in which the front edge of the photoreceptor cleaning blade is pressed to the plate of a balance, a method in which it is measured electrically by placing a sensor such as a load cell at the pressing contact position of the front edge of the photoreceptor cleaning blade with the photoreceptor 21, etc. are used.

It is desirable that the pressing angle made by the photoreceptor cleaning blade with the photoreceptor 21 is, for example, 0° to 40°, and more desirably, it should be 0° to 25°. If the processing angle is smaller than 0°, the cleaning force is lowered, which makes the image smudging tend to occur, and in contrast with this, if the pressing angle is greater than 40°, what is called "blade inversion" (also referred to as "curl-under"), which is a phenomenon of the front edge of the photoreceptor cleaning blade 261 being reversed in compliance with the photoreceptor 21, tends to be produced. In addition, the term "pressing angle with the photoreceptor 21" means an angle between the tangent plane on the photoreceptor 21 at the contact position of the front edge of the photoreceptor cleaning blade 261 with the photoreceptor 21 and the inner surface at the base end portion of the photoreceptor cleaning blade 261.

At a part of the moving path of the intermediate transfer belt 10, a secondary transfer roller 32 forming a secondary transfer region T2 (recording medium transfer region) with an opposite roller 31 positioned opposite to it and the intermediate transfer belt 10 gripped by both rollers, to make up a secondary transfer means 30 for forming secondary transfer toner image through the secondary transferring of the primary transfer toner image which has been formed on said intermediate transfer belt 10 by the application of a transfer bias voltage controlled to an appropriate magnitude to the secondary transfer roller 32 onto a recording medium which has been conveyed in synchronism with said primary transfer toner image.

At a downstream position of the secondary transfer region T2 with respect to the moving direction of the intermediate transfer belt 10, there is provided an intermediate transfer member cleaning means 35 for removing the untransferred toner particles having passed the secondary transfer region and remaining on the intermediate transfer belt 10.

The intermediate transfer member cleaning means 35 is provided with a blade cleaning mechanism having a plate-shaped intermediate transfer member cleaning blade 36 made of an elastic substance such as urethane rubber for example disposed as extending in the width direction of the intermediate transfer belt 10 (the direction parallel to the axial direction of the photoreceptor 21), with its front edge kept in pressing contact with the surface of the intermediate transfer belt 10.

It is preferred that a two-component developer containing a small-diameter non-magnetic polymerized toner (small-diameter particle toner) and small-diameter magnetic carrier be used as a developer used in the aforementioned image forming apparatus. It is particularly preferred to use the two-component developer consisting of a carrier having an average mass particle diameter of 20 to 50 $\mu$m and a non-magnetic polymerized toner having an average mass particle diameter of 3 to 5 $\mu$m.

The following describes the details of the small-diameter polymerized toner (small-diameter particle toner) and carrier used in the two-component developer.

Figure 4:
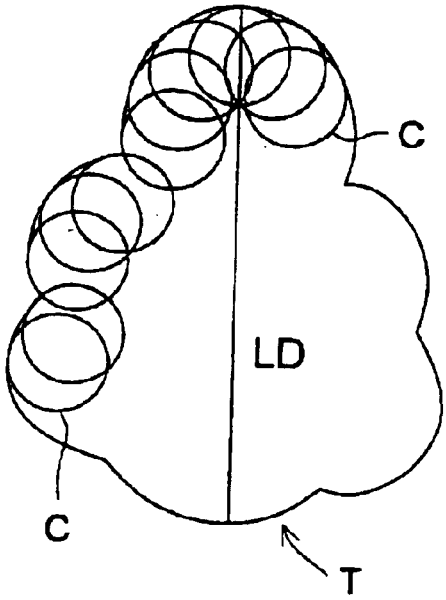
FIG. 4(A) is an illustrative drawing showing the projection chart of a toner particle having no protrusion, and each of FIG. 4(B)
FIG. 4(C) is an illustrative drawing showing the projection chart of a toner particle having a protrusion.
Figure 4:
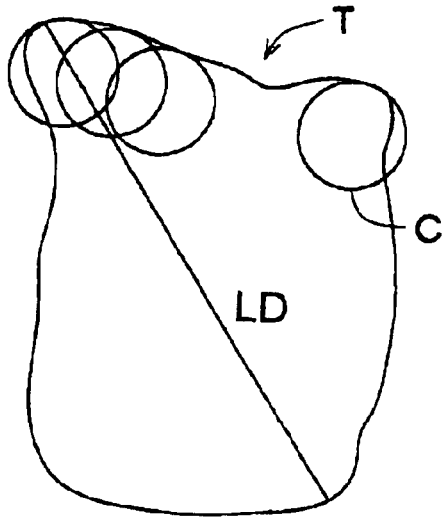
Figure 4:
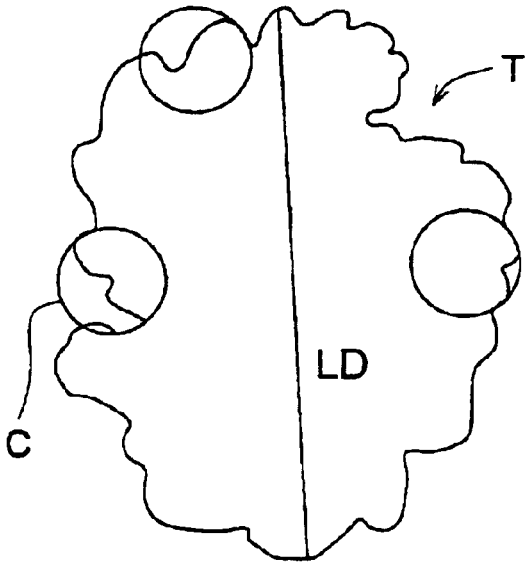
Figure 5:
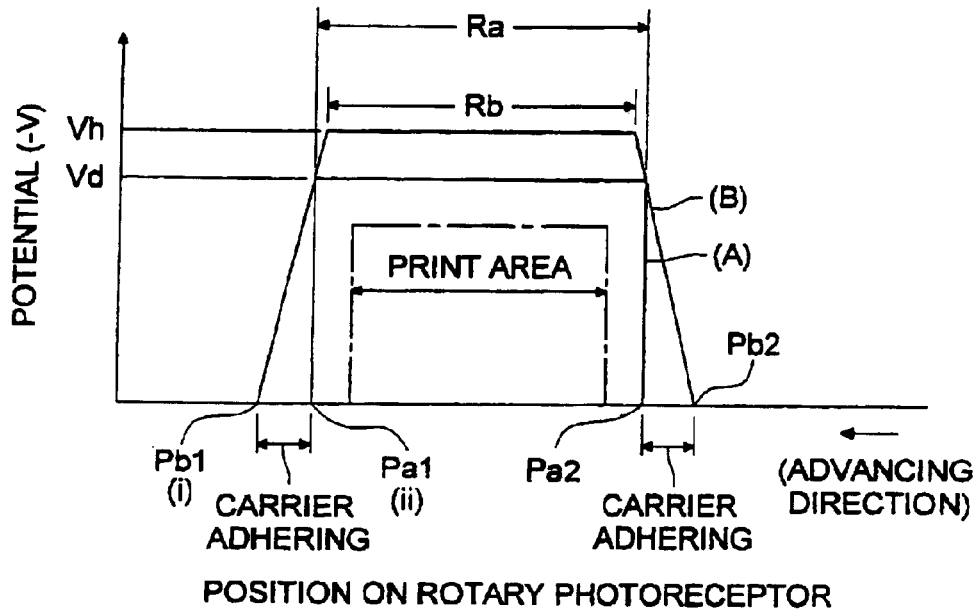
FIG. 5 is an illustrative drawing showing the relation between the surface potential of the charged photoreceptor and the development bias voltage applied in an example of the process control practiced in an image formation sequence.

First, the following describes the polymerized toner used in the present invention with reference to FIGS. 4(A) to 4(C). FIG. 4(A) shows an explanatory diagram representing a projected image of polymerized toner particle without edge, while FIGS. 4(B) and 4(C) are explanatory diagrams representing projected images of polymerized toner particle with edge.

The polymerized toner used in the present invention is preferred to consists of the following toner particles or a combination thereof: (1) Toner particles with a shape factor of 1.2 to 1.6 accounting for 65 percent or greater in number-size distribution, and the coefficient of variance of the shape factor accounting for 16 percent or smaller; (2) Toner particles with the coefficient of variance of the shape factor accounting for 16 percent or smaller and coefficient of variance in the number-size distribution accounting for 27 percent or smaller; and (3) Toner particles with the polymerized toner particles without edge accounting for 50 percent in number-size distribution.

The shape factor of the polymerized toner in the present invention is defined by the following expression and denotes the roundness of the polymerized toner particle.

$$\text{Shape factor}=((\text{maximum diameter}/2)^2\times\pi)/\text{projected area},$$

where the maximum diameter denotes the particle width wherein the distance between two parallel lines is the maximum when the projected image of a toner particle on plane surface is held between these two parallel lines. The projected area is defined as the area of the projected image of a toner particle on the plane surface.

In the present invention, the shape factor is measured has been obtained by analyzing a photograph of a toner particle magnified by 2,000 times by a scanning electron microscope using a "Scanning Image Analyzer" (by Nippon Denshi Co., Ltd.). In this case, 100 toner particles have been used to obtain the shape factor in the present invention according to the aforementioned formula.

In the polymerized toner used in the present invention, the toner particles having a shape factor of 1.2 to 1.6 are preferred to account for 65 percent or more in number-size distribution, and are more preferred to account for 70 percent in number-size distribution.

When the toner particles having a shape factor of 1.2 to 1.6 account for 65 percent or more in number-size distribution, a frictionally charged property with carrier particles or the like is more uniform. This reduces the accumulation of excessively charged toner and ensures more effective transport of toner by carrier particles, thereby minimizing phenomenal ghost or similar problems. Further, it reduces the possibility of crushing of toner particle and pollution of an electrostatic charging member (electrostatic charger), thereby ensuring stabilized electrostatic charging property of toner.

The method for controlling the aforementioned shape factor is not particularly restricted. For example, toner having a shape factor of 1.2 to 1.6 can be prepared by jetting toner particles in hot air flow, by repeatedly applying mechanical energy resulting from impact force to toner particles in gas phase, or by adding toner in undissolved solvent to apply whirling flow thereto. This can be added in normal toner so as to meet the requirements of the range specified in the present invention, thereby prepared the required toner. Further, the overall shape is controlled in the phase of preparing so-called polymerized toner, and, in the similar manner, toner having the shape factor adjusted to 1.2 to 1.6 is added to normal toner, thereby prepared the required toner.

The following formula is used to get the coefficient of variance of the shape factor of the polymerized toner preferable used in the present invention.

$$\text{Coefficient of variance } (\%)=(S/K)\times 100,$$

where "S" denotes the standard deviation of the shape factors in 100 toner particles, and "k" indicates the average of shape factor.

In the polymerized toner used in the present invention, the coefficient of variance in shape factor is preferably 16% or smaller, or more preferably 14% or smaller. When the coefficient of variance in shape factor is 16% or smaller, the void of the transferred toner layer is reduced and fixability is improved, with minimized occurrence of offset. Further, sharp distribution in the amount of electrostatic charge and improved image quality are ensured.

To control the shape factor of the toner and coefficient of variance in shape factor to be extremely uniform without variation according to lot, it is possible to determine an adequate time of terminating the process by monitoring the characteristics of toner particles (colored particles) being formed, in the step of polymerizing and fusing resin particles (polymerized particles) and controlling the shape.

"Monitoring" is defined as an action of controlling the process conditions based on the result of measurement by a measuring instrument incorporated in the inline system. That is, in the polymerized toner formed by incorporating measurements of the shape or the like in the inline system and by associating or fusing, for example, resin particles in water based medium, the shape and particle diameter are measured while sampling is performed sequentially in the step of fusing. Reaction is stopped when a desired shape has been obtained.

The method for monitoring is not restricted to any particular one. The flow type particle image analyzer FPIA-2000 (by Toa Iyo Densi Co., Ltd.) can be used. This equipment is preferred because it allows image processing to be performed on a real-time basis while a liquid sample is being fed. That is, monitoring is carried out at all times in the reaction field by a pump or the like, and the shape and other parameters are measured. Reaction is stopped when a desired shape has been obtained.

The number-size distribution and coefficient of variance in number used in the present invention are measured by the TA-II Coulter Counter or Coulter Multisizer (by Coulter Inc.). In the present invention, the Coulter Multisizer is used together with the interface for outputting particle size distribution (by Nikkaki) and personal computer connected thereto. A 100 $\mu$m aperture is used in the aforementioned Coulter Multisizer. The volume and number of the toner of 1 $\mu$m or greater are measured to calculate the particle size distribution and mass average particle diameter. Number-size distribution represents the relative frequency of toner particles with respect to particle diameter. Mass average particle diameter represents the median diameter in the number-size distribution.

$$\text{Coefficient of variance in number } (\%)=(S/Dn)\times 100,$$

where "S" denotes the standard deviation in number-size distribution, and "Dn" the mass average particle size ($\mu$m).

In the polymerized toner used in the present invention, it is preferred that the coefficient of variance in number be 27% or smaller. More preferably it should not exceed 25%. When it is kept below 27%, the void of the transferred toner layer is reduced and fixability is improved, with minimized occurrence of offset. Further, sharp distribution in the amount of electrostatic charge and improved transfer efficiency are ensured.

The method for controlling the coefficient of variance in number is not restricted any particular one. For example, it is possible to use wind force to classify toner particles. To reduce the coefficient of variance in number further, it is effective to classify them in a liquid. For classification in a liquid, there is a method of using a centrifugal separator where its speed is controlled so as to separate the collect toner particles in conformity to the difference in sedimentation speeds caused by the difference in toner particle diameters, thereby preparing the toner.

Especially when the toner is produced according to suspension polymerization method, classification is an essential step in order to ensure that the coefficient of variance in number-size distribution does not exceed 27%. According to the suspension polymerization method, polymerizable monomer is dispersed in water-based medium to get oil drops of a desired size for toner before polymerization. In other words, large oil drops of polymerizable monomer are subjected to repeated mechanical shearing by the homomixer or homogenizer to reduce the oil drops to the size of toner particles. According to such a mechanical shearing method, the number-size distribution of obtained oil drops is wide-ranging; accordingly, the particle size distribution of the toner obtained from polymerization thereof is also wide-ranging. This requires a step of classification to be performed.

In the polymerize toner used in the present invention, tne polymerized toner particle without edge refers to the toner particle that has practically no protrusion with electric charge concentrated thereon or protrusion that is likely to be worn by stress. In other words, assume that the longer diameter of the toner particle T is LD, and a circle C having a radius (LD/10) is rotated inside toner particle T in the state inscribing the circumferential line thereof at one point, as shown in FIG. 4(A). If the circle C is not substantially displaced to the outside, the toner particle is called "polymerized toner particle without edge." Here "not substantially displaced to the outside" means that the number of protrusions where the circle displaced to the outside is present does not exceed one. The "longer diameter of the polymerized toner" refers to the width of the particle wherein, if a projected image of the polymerized toner on the plane surface is sandwiched between two parallel lines, the space between these parallel lines is the maximum. It should be noted that FIGS. 4(B) and 4(C) indicate projected images of polymerized toner with edge.

The polymerized toner without edge has been measured as follows: First, a scanning electron microscope is used to take a photo showing an enlarged view of the polymerized toner particle. It is further enlarged to get a photo image times 15,000. This photo image is measured to check if the aforementioned edge is present or not. This measurement has been made on 100 polymerized toner particles.

In the polymerized toner used in the present invention, the polymerized toner particles without edge are preferably 50 percent in number-size distribution, and more preferably 70 percent or more. If they are 50 percent or more, fine particles due to stress with carrier particles do not occur easily. This will also preclude the presence of polymerized toner that easily sticks to the surface of the carrier particle and, at the same time, will control the contamination of carrier particles. Further, this will reduce the number of polymerized toner particles vulnerable to wear or breakage or polymerized toner particles having a portion prone to concentration of electrical charge, and will ensure sharp distribution of the amount of electrostatic charge and stable properties of electrostatic charge.

The method for getting polymerized toner without edge is not restricted to any particular one. For example, as described above, shape factor can be controlled by jetting toner particles in hot air flow, by repeatedly applying mechanical energy resulting from impact force to toner particles in gas phase, or by adding toner in undissolved solvent to apply a whirling flow thereto.

In the polymerized toner formed by associating or fusing resin particles, many irregular shapes are found on the surface of fused particles when fusing is stopped, and the surface is not smooth. However, toner particles without edge can be obtained by selecting appropriate conditions such as temperature in the shape control process, speed of the agitating blade and agitation time. These conditions vary with the physical properties of the resin particle. However, Toner particles characterized by smooth surface without edge can be provided by increasing the speed of rotation at a temperature equal to or greater than the glass transition temperature of resin particles, for example.

In the polymerized toner used in the present invention, small-diameter particle toner particles having a mass average particle size of 3 to 5 $\mu$m is preferred. The particle diameter of the polymerized toner can be controlled by the density of the coagulant, weight of organic solvent to be added, time of separation and sticking or composition of the polymer itself when the toner particle is formed by polymerization method.

When polymerized toner has a mass average particle diameter of 3 to 5 $\mu$m, it is possible to reduce the amount of toner with excessive adhesion to the carrier or toner with insufficient adhesion, and to provide excellent and stable cleaning properties for a long time. Further, the half-tone image quality, thin line and dot and matrix image quality will be improved. If the polymerized toner has a mass average particle diameter of small than 3 $\mu$m, image quality will tend to deteriorate due to fogging. If it is greater than 5 $\mu$m, high image quality will be reduced.

It is preferable that the toner used in the present invention should be made of toner particles whose globurizing level ranges from 0.93 to 0.96, wherein the "globurizing level" refers to the Warder's true globurizing level, $\Psi$, defined by the following numerical expression.

$\Psi$=(Specific surface area calculated assuming true globularness, from particle size distribution)/(BET specific surface area).

The "Specific surface area calculated assuming true globularness, from particle size distribution" in the above expression was measured by HELOS using a laser diffraction-type particle size distribution analyzing apparatus distributed by JEOL, and the toner particles were dispersed over 60 seconds by use of a 150 W-output ultrasonic homogenizer after a 50-cc beaker was filled with a test piece, a surface active agent, and water as a dispersion medium. Also, the "BET specific surface area" in the above expression was measured using the Model-2300 Micromeritics FlowSorb II manufactured by the Shimadzu Corporation.

In addition to enabling excellent developability to be reliably obtained, the fact that the globurizing level is from 0.93 to 0.96 enhances transfer efficiency, improving half-tone image quality and hence, thin-line and dot-matrix image quality.

It is preferable that the toner used in the present invention should be 25% or less in terms of the CV value which denotes the sharpness of the particle size distribution of the toner particles, wherein the particle size distribution of the toner particles was analyzed using the TA-II Coulter Counter (manufactured by Coulter Inc.) and the CV value was calculated using the following numerical expression.

Expression: *CV* value (%)=(Standard deviation of the particle size/Arithmetic size)×100.

Since the CV value is 25% or less, voids in the transferred toner layer (powder layer) decreases to improve fixability and to make offsets less prone to occur. The distribution of the quantity of charge can be made sharper and this, in turn, enhances transfer efficiency and improves image quality.

Although the toner used in the present invention contains at least resin and a coloring agent, the toner can also contain an external additive composed of inorganic fine particles, organic fine particles, and/or the like, as required.

It is preferable that the external additive should range from 5 to 200 nm in terms of average primary particle size, and the fine particles added to the toner should range from 0.1 to 5.0% by weight, preferably, from 0.5 to 4.0% by weight. A combination of various external additives can also be used.

The particles used as carriers can be made of well-known magnetic particles including such a metal as iron, ferrite, magnetite, or alloy of such a metal and aluminum, lead or the like. Especially use of ferrite particles is preferred. Carrier particles used with the aforementioned small-diameter polymerized toner of small-diameter particles are preferred to be small-diameter particles having a mass average particle diameter of 20 to 50 $\mu$m. The mass average particle diameter of the carrier particle can be measured typically by a laser diffraction type particle size distribution measuring instrument (HELOS) (by Sympatec Inc.) equipped with a wet type dispersion device. The aforementioned magnetic particles can be used as carriers, without any modification, but it is preferred to use the particles covered with resin or the resin dispersed carrier where magnetic particles are dispersed in the resin. Resin components for coating are not restricted in particular. For example, olefin, styrene, styrene/acryl, silicon or ester based resin, or fluorine-containing polymerized resin can be used. Further, the resin constituting the resin dispersed carrier is not particularly restricted. A known resin can be used. For example, styrene/acryl, polyester, fluorine or phenol resin can be utilized. If the mass average particle diameter of the carrier is smaller than 20 $\mu$m, adhesion of carrier tends to occur. If it is greater than 50 $\mu$m, uneven density called "scratched" will occur to the image, or other phenomena of image quality deterioration will occur.

In the above-mentioned image forming apparatus, image forming operation is carried out in the following way. In addition, hereinafter the terms "the upstream side" and "the downstream side" mean the upstream side and the downstream side with respect to the rotating direction of the photoreceptor 21, except those in cases explicitly noted.

First, in the toner image forming unit 20Y concerning the yellow toner, the photoreceptor 21 is rotated in the direction shown by the arrow mark in the drawing by the actuation of a photoreceptor driving motor (not shown in the drawing), the surface of the photoreceptor 21 is sequentially charged to the specified polarity (negative polarity for example) to be raised to the specified electric potential, and after that, a scanning exposure (image writing) is made by the exposure means 23 on the basis of the electric signal corresponding to the image data concerning the first color signal, that is, the yellow toner image; thus, an electrostatic latent image corresponding to the yellow toner image is formed on the photoreceptor 21.

On the other hand, also the surface of the developing sleeve 241 making up the developing means 24 is kept at an electric potential of the same polarity as the surface potential of the photoreceptor 21 (negative polarity for example) by the development bias voltage applied by the power source 29, and a layer of developer containing toner particles charged to the same polarity as the electric potential of the developing sleeve 241 (negative for example) is conveyed to the developing region P with the quantity of carried developer regulated by the developer quantity regulating member 242 provided with a little clearance from the outer circumferential surface of the developing sleeve 241.

Further, the surface potential of the photoreceptor 21 at the unexposed area (Vh), the surface potential of the photoreceptor 21 at the exposed area (Vl), and the electric potential of the developing sleeve (vd) have the same polarity as one another, and the absolute values satisfy the inequality Vh>Vl>Vd; hence, in the developing region P, reverse development is carried out through the deposition of toner particles off the developing sleeve 241 onto the exposed area of the photoreceptor 21, and through this process, a yellow toner image is formed on the photoreceptor 21.

The toner image formed on the photoreceptor 21 is primarily transferred onto the intermediate transfer belt 10 to form a primary transfer image, by the action of a transfer electric field which is formed in the primary transfer region T1 by the application of a suitable transfer bias voltage to the primary transfer roller 251.

A toner image forming operation as described in the above is carried out in each of the toner image forming unit 20M concerning the magenta toner, toner image forming unit 20C concerning the cyan toner, and the toner image forming unit concerning the black toner 20Bk, and the constituent color toner images formed on the photoreceptor 21 in their respective toner image forming units are primarily transferred onto the intermediate transfer belt 10 successively; thus, by the superposition of the constituent color toner images on the intermediate transfer belt 10, a primary transfer toner image is formed.

The primary transfer toner image is conveyed as it is carried on the intermediate transfer belt 10 to the secondary transfer region T2, where a transfer electric field is formed by the application of a suitable transfer bias voltage to the secondary transfer roller 32, and by the action of this transfer electric field, the primary transfer toner image is secondarily transferred onto a recording medium which has been conveyed along the conveyance path in synchronism with the primary transfer toner image; after that, a color image is formed by a fixing means carrying out a fixing processing.

On the other hand, in each of the toner image forming units, the untransferred toner particles remaining on the photoreceptor 21 having passed the primary transfer region T1 are mechanically removed by the photoreceptor cleaning blade 261 in the photoreceptor cleaning means 26 and collected; the collected toner particles are conveyed to the developing means 24 by the toner recycle mechanism, and are utilized again.

Further, the untransferred toner particles remaining on the intermediate transfer belt 10 having passed the secondary transfer region T2 are mechanically removed by the intermediate transfer member cleaning blade 36 in the intermediate transfer member cleaning means 35.

In the above-mentioned example of the first embodiment, the maximum development toner quantity supplied for development to be deposited on the photoreceptor 21 in visualizing the electrostatic latent image formed on the photoreceptor 21 is determined to be 0.3 mg/cm$^2$ to 0.6 mg/cm$^2$, and for the purpose of actualizing this state, for example, the set peripheral speed of the developing sleeve Vs is determined to be a value falling within a range of 360 mm/s to 630 mm/s, the quantity of carried developer per unit area of the developing sleeve is determined to be a value falling within a range of 60 mg/cm$^2$ to 90 mg/cm$^2$, and the ratio (Vs/Vp) of the peripheral speed Vs of the developing sleeve 241 to the peripheral speed of the photoreceptor Vp is set at a value falling within a range of 2.0 to 3.5.

In an image forming apparatus having the above-mentioned structure, when an image formation sequence by each of the toner image forming units is started, basically, in order not to produce carrier adhering, and further, in order to make the total charge quantity of toner particles forming a toner stripe which is formed inevitably on the photoreceptor 21 to be 0.04L ($\mu$C) or less, or desirably 0.01L ($\mu$C) or less, by the reduction of the quantity of toner itself composing the toner stripe, or by narrowing the width (the length in the moving direction of the photoreceptor) of the toner stripe, the adjustment of the start timing of the application of the charging voltage and the start timing of the application of the development bias voltage is carried out. In the above description, L (cm) is the length in the lengthwise direction (the length in the axial direction of the photoreceptor) of the toner stripe formed inevitably on the photoreceptor 21, and has substantially the same size as the length of the magnetized part of the developing sleeve 241.

Figure 3:
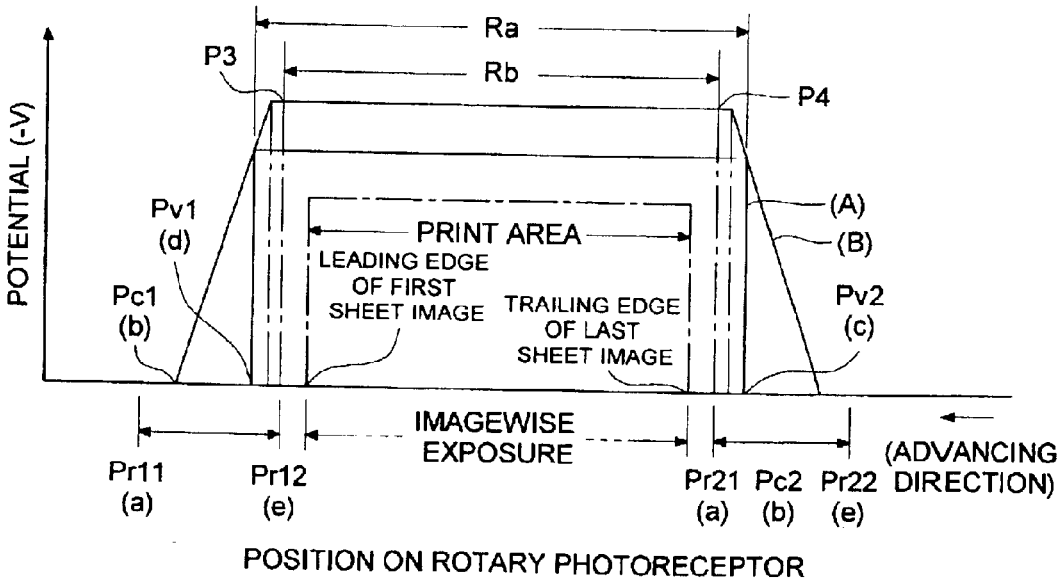
FIG. 3 is an illustrative drawing showing the relation between the surface potential of the charged photoreceptor and the development bias voltage applied in the process control practiced in the first embodiment of this invention.

To state it concretely, as shown in FIG. 3, at the starting time of an image formation sequence, simultaneously with or earlier than starting time of the application of the charging voltage (Pc1) by the charging means 22, the exposure by the exposure means 23 for making the width of the toner stripe narrower (hereinafter referred to as "specified exposure" simply) is started (Pr11). That is, for example, the specified exposure by the exposure means 23 is started at a timing between the timing when a place (a) on the photoreceptor 21 located at a more downstream position with respect to the rotating direction of the photoreceptor 21 than the place (b) on the photoreceptor 21 located at the downmost stream position in the charging voltage application region facing the charging means 22 reaches the exposure position α by the exposure means 23, and the timing when the place (b) located at the downmost stream position in the charging voltage application region at the starting time of the application of the charging voltage reaches the exposure position α by the exposure means 23 (between the place (a) and the place (b) on the photoreceptor 21) (in FIG. 3, at the timing when the point (a) reaches the exposure position α).

Further, the specified exposure by the exposure means 23 is stopped at a timing between the timing when the place (e) located at the uppermost stream position Px in the charging voltage application region at the starting time of the application of the charging voltage (Pc1) reaches the exposure position α and the timing when a place located at a more upstream position than said place (e) with respect to the rotating direction of the photoreceptor 21 reaches the exposure position α (in FIG. 3, the timing when the point (e) reaches the exposure position α).

The development bias voltage is applied to the developing sleeve 241 (Pv1) at a timing between the timing when the place (d) located at a more downstream position than the place (e) located at the exposure position at the stopping time of the specified exposure (Pr12) reaches the developing region P and the timing when the place (e) located at the exposure position α at the stopping time of the specified exposure (Pr12) reaches the developing region P (the region between the point (d) and the point (e) on the photoreceptor 21) (in FIG. 3, the timing when the point (d) reaches the developing region P).

In FIG. 3, it is desirable that the size of the region corresponding to the period of time between the starting time of the application of the development bias voltage (Pv1, the place (d) on the photoreceptor 21) and the end timing of the erasing of the charge on the photoreceptor 21 by the specified exposure (P3, the place (e) on the photoreceptor 21), that is, the size of the region where the toner stripe is formed is, for example, 15 mm or smaller (set condition (1)), or more desirably, it should be 0 mm to 5 mm.

After that, for the print area located at least at the more upstream side than the place (e) on the photoreceptor 21, image exposure for image formation is carried out by the exposure means 23, and an electrostatic latent image is formed on the photoreceptor 21.

It is desirable for the purpose of preventing the slipping through phenomenon of toner particles with certainty that the total toner quantity per one toner stripe formed inevitably in the region corresponding to the period of time between the start timing of the application of the development bias voltage (Pv1) by the developing means 24 and the stop timing of the specified exposure (P3) by the exposure means 23 is made to be 25 mg or less (set condition (2)).

Further, it is desirable that the stopping of the specified exposure by the exposure means 23 at the starting time of an image formation sequence (Pr12) is carried out at the timing when the place located, for example, at the 20 mm or more downstream side of the leading edge position of the first image area (the leading edge position of the image area of the first frame) in the print area in the image formation sequence reaches the exposure position α. By doing this, it can be prevented that the specified exposure and the image exposure for the print area where image formation should be carried out overlap each other.

Further, when an image formation sequence by each of the toner image forming units is finished, after the image exposure by the exposure means 23 for the formation of the image to form the print area is carried out, the specified exposure for narrowing the toner stripe is carried out; by doing this, basically, in order not to produce carrier adhering, and further, in order to make the total charge quantity of toner particles making up the toner stripe which is formed inevitably on the photoreceptor 21 to be 0.04L (μC) or less, or desirably 0.01L (μC) or less, by the reduction of the quantity of toner itself composing the toner stripe, or by narrowing the width (the length in the moving direction of the photoreceptor) of the toner stripe, the adjustment of the start timing of the application of the charging voltage and the start timing of the application of the development bias voltage is carried out.

That is, simultaneous with or earlier than the stopping of the application of the charging voltage (Pc2) by the charging means 22, the specified exposure by the exposure means 23 is started (Pr21). To state it concretely, for example, the specified exposure by the exposure means 23 is started at a timing between the timing when a place (a) on the photoreceptor 21 located at a more downstream position with respect to the rotating direction of the photoreceptor 21 than the place (b) on the photoreceptor 21 located at the downmost stream position in the charging voltage application region at the stopping time of the application of the charging voltage (Pc2) by the charging means 22 reaches the exposure position α, and the timing when the place (b) located at the downmost stream position in the charging voltage application region at the stopping time of the application of the charging voltage (Pc2) reaches the exposure position α (between the place (a) and the place (b) on the photoreceptor 21) (in FIG. 3, at the timing when the place (a) reaches the exposure position α).

Further, the specified exposure by the exposure means 23 is stopped at a timing between the timing when the place (e) located at the uppermost stream position Px in the charging voltage application region at the stopping time of the application of the charging voltage (Pc2) reaches the exposure position α and the timing when a place located at a more upstream position than said place (e) reaches the exposure position α (in FIG. 3, the timing when the place (e) reaches the exposure position α).

On the other hand, the application of the development bias voltage is stopped at a timing between the timing when the place (a) located at the exposure position α at the starting time of the specified exposure (Pr21) reaches the developing region P and the timing when a point (c) located at a more downstream position than said place (a) reaches the developing region P (between the place (a) and the place (c) on the photoreceptor 21) (in FIG. 3, the timing when the place (c) reaches the developing region P).

As shown in FIG. 3, it is desirable that the size of the region corresponding to the period of time between the starting time of the erasing of the charge on the photoreceptor 21 by the specified exposure by the exposure means 23 (P4, the place (a) on the photoreceptor 21) and the ending time of the application of the development bias voltage (Pv2, the place (c) on the photoreceptor 21), that is, the size of the region where the toner stripe is formed is, for example, 15 mm or smaller, or more desirably, it should be 0 mm to 5 mm (set condition (3)).

It is desirable for the purpose of preventing the slipping through phenomenon of toner particles that the total toner quantity per one toner stripe formed inevitably in the region corresponding to the period of time between the stop timing of the application of the development bias voltage (Pv2) and the start timing of the specified exposure (Pr21) by the exposure means 23 is made to be 25 mg or less (set condition (4)).

Further, it is desirable that the starting of the specified exposure by the exposure means 23 at the stopping time of an image formation sequence is carried out at the timing when the place located, for example, at the 20 mm or more upstream side of the trailing edge position of the last image area (the trailing edge position of the image area of the last frame) in the print area in the image formation sequence reaches the exposure position α. By doing this, it can be prevented that the specified exposure and the image exposure for the printing area where image formation should be carried out overlap each other.

Figure 6:
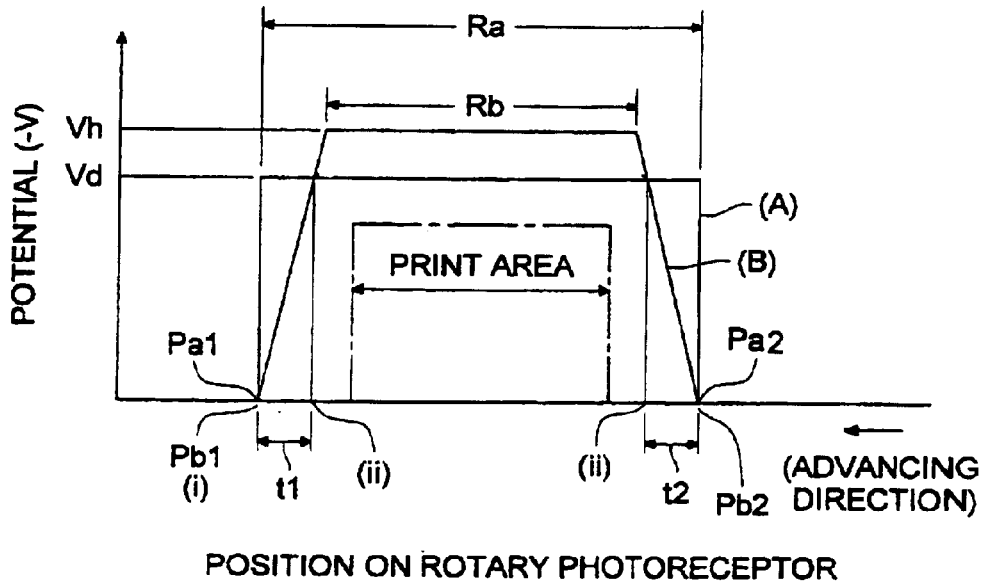
FIG. 6 is an illustrative drawing showing the relation between the surface potential of the charged photoreceptor and the development bias voltage applied in the process control practiced in the second to fourth embodiment of this invention.

Thus, by an image forming apparatus having the above-mentioned structure, when an image formation sequence is started, by starting the specified exposure (Pr11) for the photoreceptor 21 before the application of the charging voltage (Pc1) and stopping the specified exposure by the exposure means 23 immediately after the starting of the application of the development bias voltage (Pv1), to erase electric charge on the photoreceptor 21, the surface potential of the charged photoreceptor 21 is raised sharply, which makes it possible that the area where the surface potential of the charged photoreceptor 21 is kept at the specified potential value (Rb) is set within the application area of the development bias voltage (Ra), that is, the ending point of the erasing of charge by the specified exposure by the exposure means 23 (P3) is made later than starting time of the application of the development bias voltage (Pv1); this makes it possible to prevent the occurrence of carrier adhering with certainty, and on top of it, makes it possible to make the width of the toner stripe as small as possible (the area between (Pv1) and (Pr12) in FIG. 3), compared to the toner stripe which is formed in the case where the start timing of the application of the charging voltage (Pa1) and the start timing of the application of the development timing (Pb1) is determined to be substantially the same as shown in FIG. 6; therefore, it is possible to actualize with certainty a state where the total charge quantity of the toner particles making up the toner stripe is 0.04L (μC) or less.

Further, when an image formation sequence is finished, by starting the specified exposure (Pr21) for the photoreceptor 21 before the stopping of the application of the development bias voltage (Pv2) and stopping the specified exposure by the exposure means 23 immediately after the timing when the surface potential of the charged photoreceptor 21 becomes zero at the falling time of the surface potential (Pr22), to erase electric charge on the photoreceptor 21, the surface potential of the charged photoreceptor 21 is made to fall sharply, which makes it possible that the area where the surface potential of the charged photoreceptor 21 is kept at the specified potential value (Rb) is set within the application area of the development bias voltage (Ra), that is, the starting point of the erasing of charge by the specified exposure by the exposure means 23 (P4) is made earlier than the stopping time of the application of the development bias voltage (Pv2); this makes it possible to prevent the occurrence of carrier adhering with certainty, and on top of it, makes it possible to make the width of the toner stripe as small as possible (the area between (Pv2) and (Pr21) in FIG. 3), compared to the toner stripe which is formed in the case where the stop timing of the application of the charging voltage (Pa2) and the stop timing of the application of the development bias voltage (Pb2) is determined to be substantially the same as shown in FIG. 6; therefore, it is possible to actualize with certainty a state where the total charge quantity of the toner particles making up the toner stripe is 0.04L (μC) or less.

Hence, when the toner stripe which is inevitably formed on the photoreceptor 21 is removed by the photoreceptor cleaning means 26, the occurrence of a toner slipping through phenomenon is prevented with certainty, and the expected cleaning capability of the photoreceptor cleaning blade 261 can be exhibited with certainty, which makes it possible to obtain a high-quality image with certainty.

<Second Embodiment>

In the second embodiment of this invention, at the starting time and the ending time of an image formation sequence, in a state where it is made a control in order that the development bias voltage may act even on the deficiently charged area where the surface potential of the charged photoreceptor 21 is not raised to the specified potential value (Refer to FIG. 6.), by the regulation of the maximum development toner quantity for the deficiently charged area, at least at one of the starting time or ending time of the image formation sequence, the total charge quantity of the toner particles making up the toner stripe which is inevitably formed for the purpose of preventing the occurrence of carrier adhering to the photoreceptor 21 is made a specified value (0.04L (μC)) or less.

To state it concretely, as described in the above, in the case where the start timing of the application of the charging voltage by the charging means 22 (Pb1) and the start timing of the application of the development bias voltage (Pa1) are determined to be substantially simultaneous with each other, in the deficiently charged area corresponding to the period of time from the timing when a place located in the charging voltage application region at the starting time of the application of the charging voltage (Pa1) (for example, the place (i); refer to FIG. 1) reaches the developing region P to the timing when the place (ii) where the surface potential is raised to the same potential value as the development bias voltage (Vd) reaches the developing region P, toner particles contained in the developer carried on the developing sleeve 241 adhere on the surface of the photoreceptor 21, to form a toner stripe.

Further, in an image forming apparatus of this invention, the peripheral speed of the developing sleeve 241 is controlled in such a way as to make the maximum development toner quantity during the period of time between the timing when the development bias voltage is applied to the developing sleeve 241 (Pa1) and the timing when the place (ii) on the photoreceptor 21 where the surface potential is raised to the same potential value as the development bias voltage (Vd) (hereinafter referred to also as "during the formation of a useless toner image") reduced to 0.3 mg/cm$^2$ or less which is less than the set maximum development toner quantity determined in visualizing the electrostatic latent image. The "maximum development toner quantity" in this case means the maximum quantity of toner used for the visualization of the electrostatic latent image formed on the photoreceptor 21, in the case where an image formation sequence is carried out with the peripheral speed of the developing sleeve controlled to obtain the specified maximum development toner quantity.

To state it concretely, the peripheral speed of the developing sleeve at the time of forming the useless toner image Vs1 is controlled, without changing the peripheral speed Vp of the photoreceptor 21, to become smaller than the set peripheral speed of the developing sleeve Vs determined for the development of image area, that is, for the development of an electrostatic latent image on the photoreceptor 21, and at the time of the formation of the useless toner image, the ratio (Vs1/Vp) of the peripheral speed of the developing sleeve Vs1 to the peripheral speed Vp of the photoreceptor 21 is determined, for example, to be 2.0 or smaller, and desirably, to be 0.5 to 1.5.

As regards the period of time for the adjustment of the peripheral speed of the developing sleeve 241, although it depends on the magnitude of the peripheral speed Vp of the photoreceptor 21 etc., it is desirable that, for example, in the case where the peripheral speed Vp of the photoreceptor 21 is 180 mm/s to 320 mm/s, and the peripheral speed Vs of the developing sleeve 241 is 360 mm/s to 1120 mm/s, it is the period of time from the timing when a place located in the charging voltage application region at the starting time of the application of the charging voltage (Pb1) (for example, the place (i) located at the downmost stream position in the charging voltage application region) reaches the developing region P to the timing when the place (ii) located at the 10 mm to 30 mm upstream side of said place (i) with respect to the rotating direction of the photoreceptor 21 reaches the developing region P.

Further, as regards the print area where the surface potential has been raised up to the specified potential value, located in the upstream side of the place (ii) on the photoreceptor 21, an electrostatic latent image corresponding to an original image is formed through the image exposure by the exposure means 23, and in visualizing this electrostatic latent image, so as to obtain the maximum development toner quantity determined for the development of the image area in the print area, the electrostatic latent image is developed with the peripheral speed of the developing sleeve 241 controlled to come back to the original state, that is, to become the set peripheral speed Vs, to form a toner image on the photoreceptor 21.

Further, at the ending time of an image formation sequence, in the case where the stop timing of the application of the charging voltage (Pb2) and the stop timing of the application of the development bias voltage (Pa2) are determined to be substantially simultaneous with each other, in the deficiently charged area between a place on the photoreceptor 21 where the surface potential has the same potential value as the development bias voltage (Vd), which is lower than the specified potential value (Vh), at the falling time of the surface potential located at the more downstream side than a place located in the charging voltage application region at the stopping time of the application of the charging voltage (Pb2), and a place located in the developing region at the stopping time of the development bias voltage (Pa2), a toner stripe is formed; the peripheral speed of the developing sleeve 241 is controlled in such a way that the maximum development toner quantity during the formation of the useless toner image between the timing when the place where the surface potential of the charged photoreceptor 21 has a low potential value equal to the development bias voltage (Vd) at the falling time of the surface potential reaches the developing region P and the timing when the application of the development bias voltage to the developing sleeve 241 is stopped (Pa2), is reduced from the set maximum development toner quantity determined in visualizing the electrostatic latent image to 0.3 mg/cm$^2$ or less.

At the ending time of an image formation sequence, as regards the period of time for the adjustment of the peripheral speed of the developing sleeve 241, although it depends on the magnitude of the peripheral speed Vp of the photoreceptor 21 etc., it is desirable that, for example, in the case where the peripheral speed Vp of the photoreceptor 21 is 180 mm/s to 320 mm/s, and the peripheral speed Vs of the developing sleeve 241 is 360 mm/s to 1120 mm/s, it is made the period from the timing when the place located, with respect to the rotating direction of the photoreceptor 21, at the 0 mm to 40 mm downstream side of a place located in the charging voltage application region at the stopping time of the application of the charging voltage (Pb2) (for example, the place located at the downmost stream position in the charging voltage application region) reaches the developing region P to the timing when the application of the development bias voltage to the developing sleeve 241 is stopped (Pa2).

In the above description, as regards the rotational operation of the developing sleeve 241, for the reason that, in the case where only the photoreceptor 21 is rotated, no toner is supplied to the development nip portion in the developing region P, which produces a risk of carrier adhering to the photoreceptor 21 being produced, when an image formation sequence is started, it is started approximately simultaneously with the start of rotation of the photoreceptor 21, and from the viewpoint of the prevention of the occurrence of carrier adhering to the photoreceptor 21, it is stopped approximately simultaneously with the stop of the photoreceptor 21.

By an image forming apparatus having the above-mentioned structure, at the starting time and the ending time of an image formation sequence, under a condition set so as to form a toner stripe on the photoreceptor 21 positively for the purpose of preventing the occurrence of carrier adhering to the photoreceptor 21, during the formation of the useless toner image to produce toner deposition on the photoreceptor 21, the maximum development toner quantity is reduced from the maximum development toner quantity during the development of an image area to 0.3 mg/cm$^2$ or less by the control of the peripheral speed of the developing sleeve 241, which reduces the toner quantity inevitably adhering to the photoreceptor 21 to a small amount not more than a certain value, and makes the total charge quantity of the toner particles making up the toner stripe 0.04L ($\mu$C) or less; therefore, it is possible to reduce the load given to the photoreceptor cleaning blade 261 in the photoreceptor cleaning means 26 by a large margin, and owing to this, the expected cleaning effect can be exhibited with certainty. As the result, it is possible to remove the untransferred toner particles remaining on the photoreceptor 21 with certainty, and hence, an image having a high image quality can be formed with certainty.

Further, particularly, in a monochromatic image forming apparatus, because the quantity of toner particles deposited on the photoreceptor is a small amount less than a certain value, the amount of recycle toner particles collected by the photoreceptor cleaning means and conveyed to the developing means again becomes small; therefore, it is possible to lower the degree of non-uniformity in the charge quantity of toner particles, and hence, the performance of the developer can be maintained over a long period of time; on top of it, because the toner consumption can be made less, the expected image formation can be practiced advantageously.

<Third Embodiment>

In the third embodiment of this invention, at the starting time and the ending time of an image formation sequence, in a state where a control is practiced in such a way that the development bias voltage acts even on the deficiently charged area where the surface potential of the charged photoreceptor 21 is not raised to the specified potential value (Refer to FIG. 6.), by the transferring of a part or the whole of the toner particles making up the toner stripe formed on the deficiently charged area to the intermediate transfer belt 10, at least at one of the starting time and the ending time of an image formation sequence, the total charge quantity of the toner particles making up the toner stripe which is inevitably formed on the photoreceptor 21 is made a specified value (0.04L ($\mu$C)) or less.

To state it concretely, by a transfer electric field which is formed in the primary transfer region T1 by the application of a suitable transfer bias voltage to the primary transfer roller 251 and acts not only on the image area on the photoreceptor where a toner image corresponding to image data is formed, but also on the deficiently charged area t1 corresponding to the period from the timing when the development bias voltage is applied to the developing sleeve 241 (Pa1) to the timing when the place on the photoreceptor 21 (ii) where the surface potential is the same as the development bias voltage (Vd) which is lower than the specified potential value (Vh) reaches the developing region P (hereinafter referred to also as a "useless toner image area"), a part or the whole of the toner particles making up the toner stripe are transferred onto the intermediate transfer belt 10.

Further, on the intermediate transfer belt 10, the toner stripe is removed by the intermediate transfer member cleaning means 35, while the toner particles remaining on the photoreceptor 21 are removed by the photoreceptor cleaning means 26, if residual toner particles of the toner stripe are present on the photoreceptor 21.

In the above, it is desirable that the amount of toner particles to be transferred onto the intermediate transfer belt 10 out of the toner particles forming the toner stripe is at least 80% or more to the toner quantity of the toner stripe, and more desirably, it should be 100%.

Further, it is desirable that the transfer electric field acts on an area of 80% or larger to the area on the photoreceptor 21 t1 where the useless toner image is formed, and more desirably, it should act on the whole of the area t1 where the useless toner image is formed.

As regards the duration of the transfer electric field acting for transferring the toner stripe on the photoreceptor 21 to the intermediate transfer belt 10, although it depends on the magnitude of the peripheral speed Vp of the photoreceptor 21 etc., it is desirable that, for example, in the case where the peripheral speed Vp of the photoreceptor 21 is 180 mm/s to 320 mm/s, and the peripheral speed Vs of the developing sleeve 241 is 360 mm/s to 1120 mm/s, it is made the period from the timing when a place located in the charging voltage application region at the starting time of the application of the charging voltage (Pb1) (for example, the place located at the downmost stream position in the charging voltage application region (i)) reaches the developing region to the timing when the place (ii) located at the 10 mm to 30 mm upstream side of said place (i) with respect to the rotating direction of the photoreceptor 21 reaches the developing region P.

Further, also at the ending time of an image formation sequence, at the rising time of the surface potential of the charged photoreceptor, by the action of the transfer electric field formed in the primary transfer region T1 by the application of the transfer bias voltage controlled to a suitable magnitude to the primary transfer roller 251 on the useless toner image formation area t2 corresponding to the timing when a place on the photoreceptor 21 where its surface potential has the same potential value as the development bias voltage (Vd), which is lower than the specified potential value (Vh), reaches the developing region P to the timing when the application of the development bias voltage to the developing sleeve 241 is stopped (Pa2), a part or the whole of the toner particles making up the toner stripe are transferred onto the intermediate transfer belt 10.

Then, on the intermediate transfer belt 10, the toner stripe is removed by the intermediate transfer member cleaning means 35, while the toner particles remaining on the photoreceptor 21 are removed by the photoreceptor cleaning means 26, if residual toner stripe is present on the photoreceptor 21.

At the ending time of an image formation sequence, as regards the duration of the action of the transfer electric field for transferring the toner stripe on the photoreceptor 21 to the intermediate transfer belt 10, although it depends on the magnitude of the peripheral speed Vp of the photoreceptor 21 etc., it is desirable that, for example, in the case where the peripheral speed Vp of the photoreceptor 21 is 180 mm/s to 320 mm/s, and the peripheral speed Vs of the developing sleeve 241 is 360 mm/s to 1120 mm/s, it is made the period from the timing when the place located, with respect to the rotating direction of the photoreceptor 21, at the 0 mm to 40 mm downstream side of a place located in the charging voltage application region at the stopping time of the application of the charging voltage (Pb2) (for example, the place located at the downmost stream position in the charging voltage application region) reaches the developing region P to the timing when the application of the development bias voltage to the developing sleeve 241 is stopped (Pa2).

By an image forming apparatus having the above-mentioned structure, at the starting time and the ending time of an image formation sequence, under a condition set in such a way that a toner stripe is formed positively for the purpose of preventing the occurrence of carrier adhering to the photoreceptor 21, by the transferring of a part or the whole of the toner particles making up the toner stripes formed in the useless toner image formation areas t1 and t2 onto the intermediate transfer belt 10, the amount of the toner particles to be removed by the photoreceptor cleaning means 26 in the useless toner particles forming the stripe-shaped zone inevitably formed on the photoreceptor 21 becomes zero or extremely small, which actualizes a state that the total charge quantity of the toner particles forming the toner stripe is 0.04L ($\mu$C) or less; therefore, it is possible to reduce the load given to the photoreceptor cleaning blade 261 by a large margin.

As the result of that, without the pressing force of the photoreceptor cleaning blade 261 being strengthened, the expected cleaning effect by the photoreceptor cleaning blade 261 can be exhibited with certainty, and the residual toner particles remaining on the photoreceptor 21 can be removed with certainty. Further, as regards the useless toner particles transferred onto the intermediate transfer belt 10 too, without giving an excessively heavy load to the intermediate transfer member cleaning blade 36 in the intermediate transfer member cleaning means 35 provided at the intermediate transfer belt 10, the useless toner particles on the intermediate transfer belt 10 can be removed with certainty, and hence, an image having a high image quality can be formed with certainty.

Further, by the transferring of the toner stripe formed in the useless toner image formation area on the photoreceptor 21 onto the intermediate transfer belt 10 and the removing of this by the intermediate transfer member cleaning means 35, because basically the intermediate transfer belt 10 is made of a material more excellent in mechanical durability than the photoreceptor 21, the useless toner particles transferred onto the intermediate transfer belt 10 can be removed with certainty, and by the suitable selection of the material to compose the intermediate transfer belt 10, the pressing force of the intermediate transfer member cleaning blade 36 for the intermediate transfer belt 10 can be strengthened, which makes it possible to remove the useless toner particles with higher certainty.

In a toner image forming unit of the third embodiment, in the case where the set maximum development toner quantity determined in developing an electrostatic latent image is greater than 0.6 mg/cm$^2$, it is possible to make a structure in which, at least in one of the useless toner image forming area t1 at the starting time of an image formation sequence and the useless toner image forming area t2 at the ending time of the image formation sequence, the peripheral speed of the developing sleeve is controlled so as to reduce the maximum development toner quantity to a half of the set maximum development toner quantity or less. The term "the maximum development toner quantity" means the maximum quantity of the toner particles supplied for the development of an electrostatic latent image on the photoreceptor 21 and deposited on the photoreceptor 21, in the case where an image formation sequence is carried out in a state such that the peripheral speed of the developing sleeve 241 is controlled to give the specified maximum development toner quantity.

To state it concretely, the peripheral speed Vs1 of the developing sleeve 241 in the useless toner image forming area t1 is controlled, without the peripheral speed Vp of the photoreceptor 21 being changed, to become smaller than the set peripheral speed Vs of the developing sleeve 241 determined for the development of an image area, that is, for the development of an electrostatic latent image on the photoreceptor 21, and in the useless toner image forming area t1, the ratio (Vs1/Vp) of the peripheral speed of the developing sleeve Vs1 to the peripheral speed Vp of the photoreceptor 21 is determined, for example, to be 2.0 or smaller, and desirably, to be 0.5 to 1.5.

Further, as regards the image area where the surface potential is raised up to the specified potential value (Vh), located in the upstream side of the useless toner formation area t1, that is, in the more upstream side than the place (ii) on the photoreceptor 21, an electrostatic latent image corresponding to an original image is formed through the image exposure by the exposure means 23, and in visualizing this electrostatic latent image, so as to obtain the maximum development toner quantity determined for the development of the print area, the electrostatic latent image is developed with the peripheral speed of the developing sleeve 241 controlled to come back to the original state, that is, to become the set peripheral speed Vs, to form a toner image on the photoreceptor 21.

Further, at the ending time of an image formation sequence, in the useless toner image forming area t2 corresponding the period of time from the timing when the place on the photoreceptor 21 where the surface potential has the same potential value as the development bias voltage (Vd), which is lower than the specified potential value (Vh), at the falling time of the surface potential reaches the developing region P, to the timing when the application of the development bias voltage to the developing sleeve is stopped (Pa2), the peripheral speed of the developing sleeve is controlled so as to reduce the maximum development toner quantity to a half of the set maximum development toner quantity or less.

By an image forming apparatus having the above-mentioned structure, even in the case where the maximum development toner quantity for the image area development is determined to be comparatively large, at the starting time and the ending time of an image formation sequence, under a condition set in such a way that a toner stripe is formed on the photoreceptor 21, by the maximum development toner quantity being reduced from the maximum development toner quantity to the specified amount through the controlling of the peripheral speed of the developing sleeve 241 during the useless toner forming times t1 and t2, the amount of toner particles making up the toner stripe formed inevitably on the photoreceptor 21 is reduced to a small amount not more than a definite value; on top of it, a part or the whole of the useless toner particles deposited on the photoreceptor 21 are transferred to the intermediate transfer belt, which makes the amount of the useless toner particles to be removed by the photoreceptor cleaning blade 261 in the photoreceptor cleaning means 26 extremely small; thus, because it can be actualized with certainty a state that the total charge quantity of the useless toner particles remaining on the photoreceptor 21 is 0.04L ($\mu$C) or less, the load given to the photoreceptor cleaning blade 261 can be lowered by a large margin.

As the result of that, the expected cleaning effect by the photoreceptor cleaning blade 261 in the photoreceptor cleaning means 26 can be exhibited with certainty, and the residual toner particles remaining on the photoreceptor 21 can be removed with certainty.

Further, as regards the useless toner particles to be removed by the intermediate transfer member cleaning means 35 on the intermediate transfer belt 10 too, because its amount is not increased by a large margin, without an excessively heavy load given to the intermediate transfer member cleaning blade 36 in the intermediate transfer member cleaning means 35, the expected cleaning effect by the intermediate transfer member cleaning blade 36 can be exhibited with certainty; as the result, the useless toner particles remaining on the intermediate transfer belt 10 can be removed with certainty, and hence, an image having a high image quality can be formed with certainty.

Moreover, in a monochromatic image forming apparatus, because the amount of toner particles deposited on the photoreceptor is a small amount not larger than a definite value, the amount of the recycle toner particles which are collected by the photoreceptor cleaning means and the intermediate transfer member cleaning means and conveyed to the developing means again is small; owing to this, the degree of the non-uniformity in the toner charge quantity is made lower, and hence, the performance of the developer can be maintained over a long period of time, and on top of it, the toner consumption can be made less; therefore, the expected image formation can be performed advantageously.

<Fourth Embodiment>

In the fourth embodiment of this invention, in a state that a control is practiced so as to apply a development bias voltage also in a deficiently charged area where the surface potential of the charged photoreceptor is not raised up to the specified potential value (Refer to FIG. 6.) at the starting time and the ending time of an image formation sequence, by a charge elimination electric field being made to act in the deficiently charged area at least at one of the starting time and the ending time of the image formation sequence, the total charge quantity of the toner particles making up the toner stripe inevitably formed on the photoreceptor is made equal to or less than a specified value (0.04L ($\mu$C)).

Figure 7:
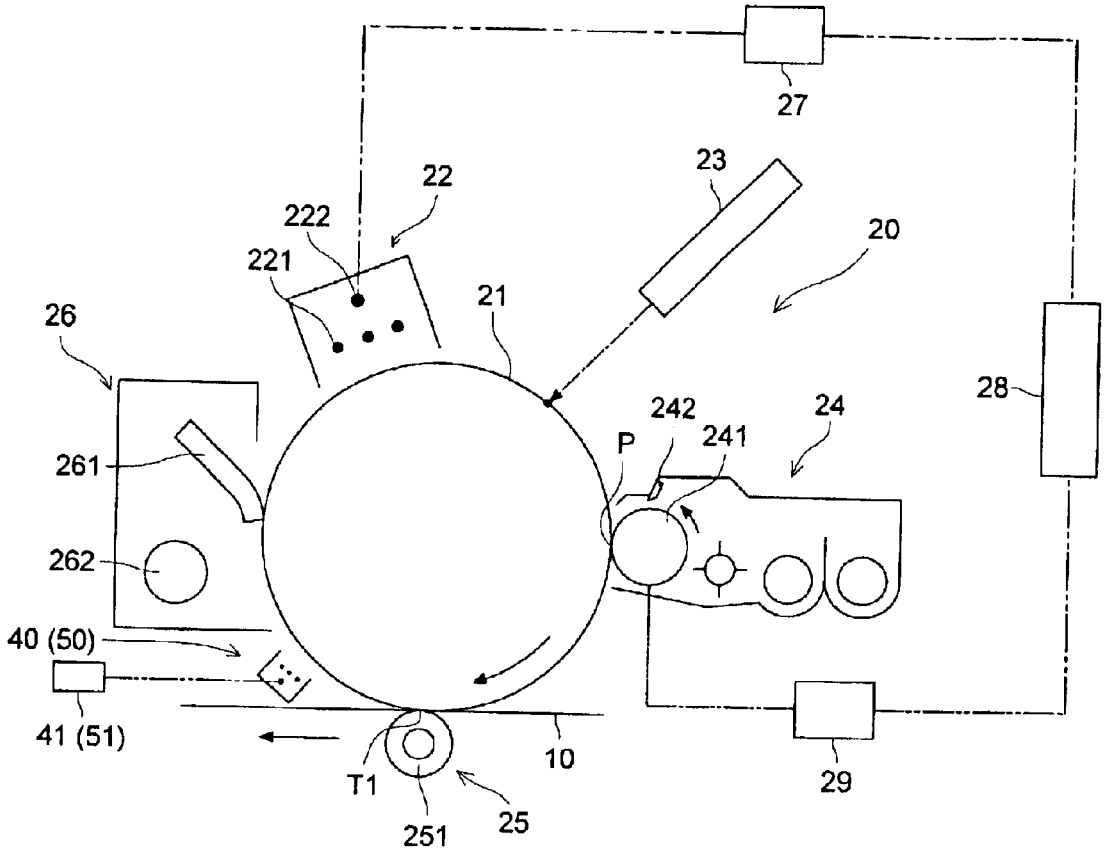
FIG. 7 is an illustrative drawing showing another example of the structure of a toner image forming unit in the image forming apparatus shown in FIG. 1.

FIG. 7 is an illustrative drawing showing another example of the structure of the toner image forming unit in the image forming apparatus shown in FIG. 1, and the same sign is attached to the constituent members having the same structure as those shown in FIG. 1 for convenience.

In this toner image forming unit, at an upstream position of the cleaning region by the photoreceptor cleaning means 26 with respect to the rotating direction of the photoreceptor 21, there is provided a toner charge reducing means 40 for reducing the charge quantity of the untransferred toner particles remaining on the photoreceptor 21 having passed the primary transfer region T1 by the application of an alternate-current discharging voltage.

The toner charge reducing means 40 is made up, for example, of a corona discharging device, and to the discharging electrode, an alternate-current power source 41 for applying an alternate-current discharging voltage is connected.

The magnitude of the alternate-current discharging voltage to be applied to the discharging electrode is made to be such one that the residual toner particles on the photoreceptor 21 are not detached off the photoreceptor 21 by the action of the discharging electric field formed between the discharging electrode having the alternate-current discharging voltage applied and the photoreceptor 21, for example, such one that 30% to 40%, or desirably 30% to 60% of the charge quantity of the toner particles on the photoreceptor 21 are eliminated and the charge quantity of the toner stripe (charge density) after the action of the discharging electric field becomes 35 $\mu$C/g (absolute value) or less, or desirably it should be 20 $\mu$C/g to 35 $\mu$C/g (absolute value).

Figure 8:
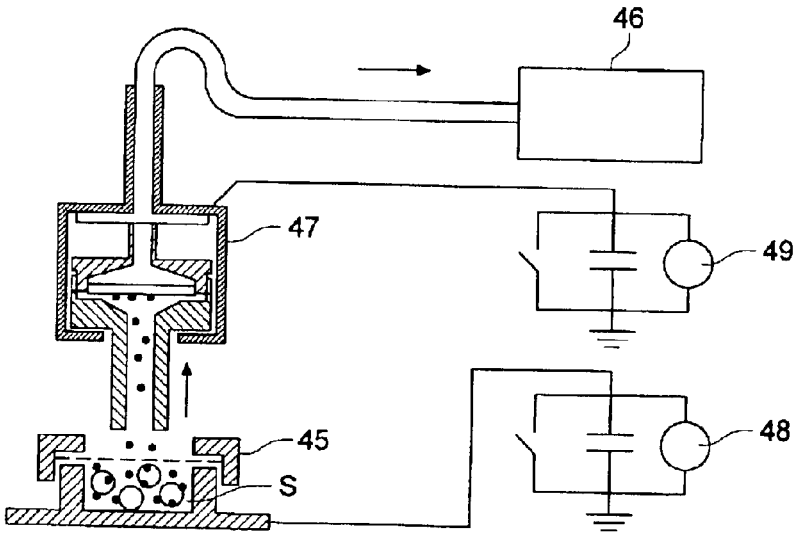
FIG. 8 is an illustrative drawing showing the outline of the structure of a measuring instrument for measuring toner charge quantity.

The measurement of toner charge quantity per unit mass can be made by a blow-off method for example. To state it concretely, the toner charge quantity per unit mass Q is obtained from the equation Q=q/m, where q is the charge quantity and m is the mass of toner particles obtained in the following way. That is, as shown in FIG. 8, some amount of a sample developer S, whose weight has been measured beforehand, is put in a sample container (a Faraday cage) 45 made of a conductive substance, and the toner particles and the carrier particles are separated by the action of a suitable suction means 46 to suck the toner particles only, which are captured by a toner capturing container 47 made of a conductive substance; further, the weight of the carrier particles left in the sample container 45 is measured, and the weight of the toner particles is obtained from the difference of the weight of the sample developer S and the weight of the carrier particles; on the other hand, the charge quantity of the carrier remaining in the sample container 45 which is equivalent to the charge quantity of the toner particles is measured by an electrometer 48 connected to the sample container 45, or the charge quantity of the toner particles captured in the toner capturing container 47 by an electrometer 49 connected to the toner capturing container 47.

Further, in the image forming unit having the above-mentioned structure, at the starting time of an image formation sequence, in a state that, on the useless toner image forming area t1 on the photoreceptor 21 corresponding to the period of time from the timing when the development bias voltage is applied to the developing sleeve 241 (Pa1) to the timing when the place on the photoreceptor 21 where the surface potential has the same potential value as the development bias voltage Vd, which is lower than the specified potential value (Vh), reaches the developing region P, a charge eliminating electric field is made to act, by the toner charge reducing means 40 having an alternate-current discharging voltage applied, to reduce the charge quantity of the toner particles forming the toner stripe, said toner stripe is removed by the photoreceptor cleaning means 26.

As regards the duration of the charge eliminating electric field acting on the toner stripe on the photoreceptor 21, although it depends on the magnitude of the peripheral speed Vp of the photoreceptor 21, for example, in the case where the peripheral speed Vp of the photoreceptor 21 is 180 mm/s to 320 mm/s, and the peripheral speed Vs of the developing sleeve 241 is 360 mm/s to 1120 mm/s, it is desirable that it is made the period from the timing when a place located in the charging voltage application region at the starting time of the charging voltage (Pb1) (for example, the place located at the downmost stream position in the charging voltage application region(i)) reaches the developing region P to the timing when the place located at the 10 to 30 mm upstream position of said place (i) with respect to the rotating direction of the photoreceptor 21 (ii) reaches the developing region.

Further, at the ending time of an image formation sequence, in a state that, on the useless toner image forming area t2 on the photoreceptor 21 corresponding to the period of time from the timing when the place on the photoreceptor 21 where the surface potential has the same potential value as the development bias voltage Vd, which is lower than the specified potential value (Vh), reaches the developing region P, to the timing when the application of the development bias voltage is stopped (Pa2), a charge eliminating electric field is made to act, by the toner charge reducing means 40 having an alternate-current discharging voltage applied, to reduce the charge quantity of the toner particles forming the toner stripe, said toner stripe is removed by the photoreceptor cleaning means 26.

As regards the duration of the charge eliminating electric field acting on the toner stripe on the photoreceptor 21 at the ending time of an image formation sequence, although it depends on the magnitude of the peripheral speed Vp of the photoreceptor 21, for example, in the case where the peripheral speed Vp of the photoreceptor 21 is 180 mm/s to 320 mm/s, and the peripheral speed Vs of the developing sleeve 241 is 360 mm/s to 1120 mm/s, it is desirable that it is made the period from the timing when the place located at the more downstream position by 0 to 40 mm with respect to the rotating direction of the photoreceptor 21 than a place located in the charging voltage application region at the stopping time of the charging voltage (Pb2) (for example, the place located at the downmost stream position in the charging voltage application region) reaches the developing region P to the timing when the application of the development bias voltage to the developing sleeve 241 is stopped (Pa2).

By an image forming apparatus having the above-mentioned structure, under a condition that the operation of the toner image forming unit is set in such a way that a toner stripe is inevitably formed on the photoreceptor 21 at the starting time and the ending time of an image formation sequence, by the reduction of the charge quantity of the toner particles forming the toner stripe caused by the action of a charge eliminating electric field produced by the toner charge reducing means 40 having an alternate-current discharging voltage applied on the useless toner image forming areas t1 and t2 on the photoreceptor 21, it is obtained a state that the total charge quantity of the toner particles forming said toner stripe is 0.04L ($\mu$C) or less, which makes the adhering force of the toner stripe to the photoreceptor 21 small; therefore, it is possible to reduce the load given to the photoreceptor cleaning blade 261 in the photoreceptor cleaning means 26 by a large margin, and owing to this, the expected cleaning effect can be exhibited with certainty. As the result, the untransferred toner particles on the photoreceptor 21 including those of the toner stripe can be removed with certainty, and hence, an image having a high image quality can be formed with certainty.

In the toner image forming unit of the fourth embodiment, it is possible to make the toner charge reducing means have such a structure as to reduce the charge quantity of the untransferred toner particles on the photoreceptor 21 including those of the toner stripe by the application of a direct-current discharging voltage having the polarity reverse to the charge polarity of the toner.

To explain it concretely with reference to FIG. 7, a toner charge reducing means 50 is made up of a corona discharging device for example, and to its discharging electrode, a direct-current power source 51 for applying a direct-current discharging voltage of the reverse polarity to the charge polarity of the toner.

The magnitude of the direct-current discharging voltage of the reverse polarity to the charge polarity of the toner to be applied to the discharging electrode is made to be such one that the untransferred toner particles on the photoreceptor 21 is not detached off the photoreceptor 21 by the action of the charge eliminating electric field formed between the discharging electrode and the photoreceptor 21 by the direct-current discharging voltage applied to the discharging electrode, for example, such one that a charge quantity of 30% to 40%, desirably 30% to 60% to the charge quantity of the untransferred toner particles on the photoreceptor 21 is eliminated and the charge quantity of the untransferred toner particles after the action of the charge eliminating electric field becomes 35 $\mu$C/g (absolute value), or desirably, 20 to 35 $\mu$C/g (absolute value).

In a toner image forming unit having the above-mentioned structure, at the starting time of an image formation sequence, in a state that, on the useless toner image forming area t1 on the photoreceptor 21 corresponding to the period of time from the timing when the development bias voltage is applied to the developing sleeve 241 (Pa1) to the timing when the place on the photoreceptor 21 where the surface potential has same potential value as the development bias voltage Vd, which is lower than the specified potential value (vh) reaches the developing region P, a charge eliminating electric field is made to act, by the toner charge reducing means 50 with a direct-current discharging voltage of the polarity reverse to the charge polarity of the toner applied, to reduce the charge quantity of the toner particles forming the toner stripe, said toner stripe is removed by the photoreceptor cleaning means 26.

Further, at the ending time of an image formation sequence, in a state that, on the useless toner image forming area t2 on the photoreceptor 21 corresponding to the period of time from the timing when the place on the photoreceptor 21 where the surface potential has the same potential value as the development bias voltage Vd, which is lower than the specified potential value (Vh), at the falling time of the surface voltage reaches the developing region P, to the timing when the application of the development bias voltage is stopped (Pa2), a charge eliminating electric field is made to act, by the toner charge reducing means 50 having a direct-current discharging voltage of the reverse polarity to the charge polarity of the toner applied, to reduce the charge quantity of the toner particles forming the toner stripe, said toner stripe is removed by the photoreceptor cleaning means 26.

By an image forming apparatus having the above-mentioned structure, the charge quantity of the toner particles forming the toner stripe is reduced by the action of a charge eliminating electric field, produced by the toner charge reducing means 50 with a direct-current discharging voltage of the same polarity to the charge polarity of the toner applied, on the useless toner image forming areas t1 and t2 on the photoreceptor 21; owing to this, it is obtained a state that the total charge quantity of the toner particles forming said toner stripe is 0.04L ($\mu$C) or less, which makes the adhering force of the toner zone to the photoreceptor 21 small; therefore, the following effects can be obtained: it never happens that the load given to the photoreceptor cleaning blade 261 in the photoreceptor cleaning means 26 becomes excessively heavy, and the expected cleaning effect can be exhibited with certainty; at the same time, the toner stripe on the photoreceptor 21 including those of can be removed with certainty, and hence, an image having a high image quality can be formed with certainty.

As explained in the foregoing, by this invention, it is possible to reduce the load given to the photoreceptor cleaning blade 261 in the photoreceptor cleaning means 26 and the intermediate transfer member cleaning blade 36 in the intermediate transfer member cleaning means 35 by a large margin, and the expected cleaning effect can be exhibited with certainty; therefore, this invention is extremely effective even in the case where a toner composed of toner particles having a small particle size which tends to produce a cleaning defect such as "slipping through" for example, or a toner composed of toner particles having a nearly spherical shape is used, for example.

Especially, in the image forming apparatus according to the first embodiment, as will be made clear by the samples to be described later, this invention is extremely effective because the width of the toner stripe formed inevitably on the photoreceptor can be brought in a state of being extremely small, even in the case where the process speed is set at 300 mm/s or higher for example.

Up to now, the embodiment of this invention have been explained; however, this invention should not be limited to the above-mentioned embodiment, and various kinds of modification can be applied.

For example, as regards the control of the peripheral speed of the developing sleeve for the deficiently charged area at the starting time and the ending time of an image formation sequence to be practiced in the second embodiment, the operation control of the transferring of the useless toner image to the intermediate transfer member and the control of the peripheral speed of the developing sleeve for the deficiently charged area at the starting time and the ending time of an image formation sequence to be practiced in the third embodiment, or the operation for making a charge eliminating electric field act on the deficiently charged area, for example, at the starting time and the ending time of an image formation sequence to be practiced in the fourth embodiment, it is also possible to carry out it at either the starting time or the ending time of an image formation sequence, for example, only at the starting time of an image formation sequence; however, it is desirable to carry out the control or the operation at both of the starting time and the ending time of an image formation sequence.

Figure 9:
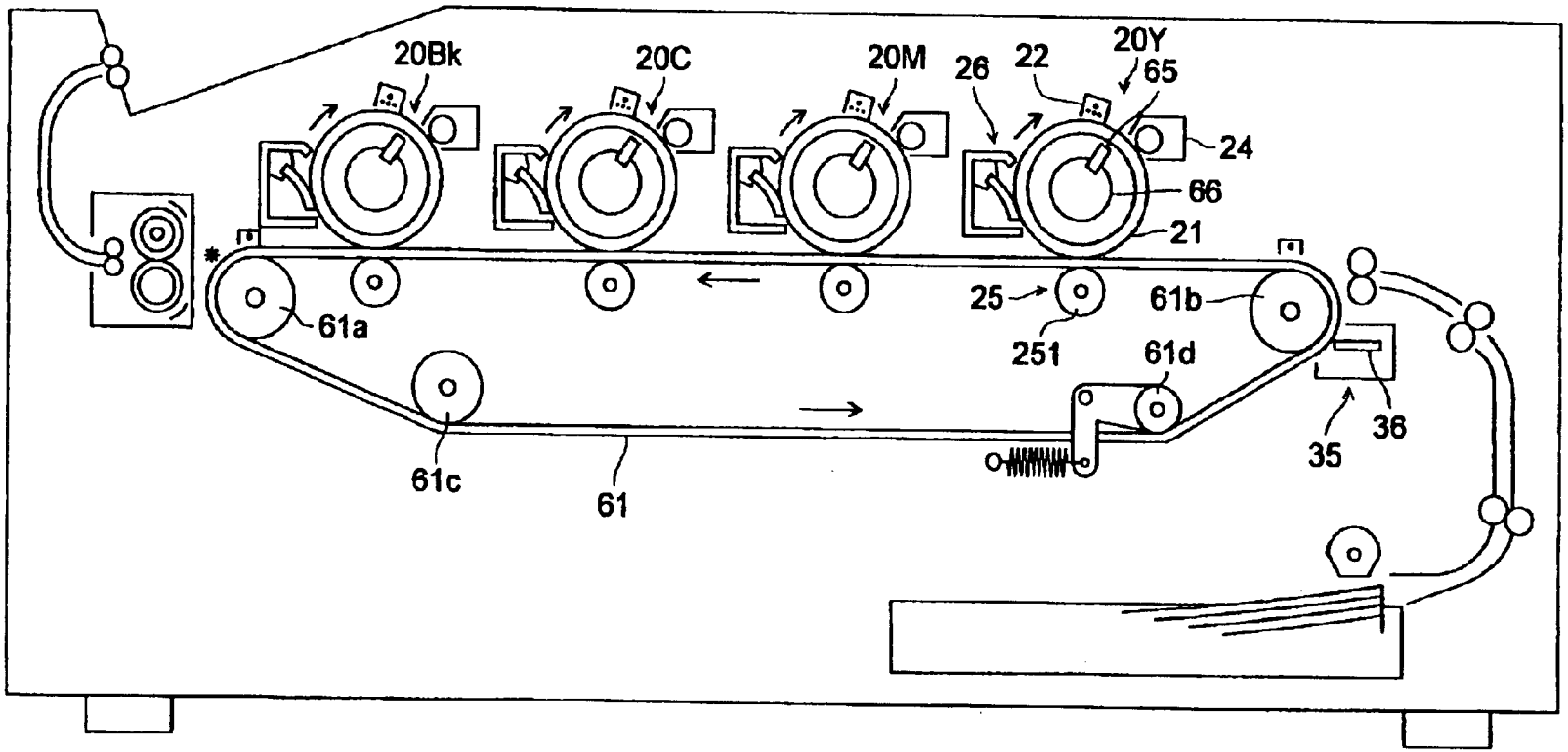
FIG. 9 is an illustrative drawing showing the outline of the structure of another example of an image forming apparatus of this invention.

Further, in the first example, the second example, and the third embodiment, this invention is not to be limited to an image forming apparatus of an intermediate transfer type, and as shown in FIG. 9, it is possible to make the image forming apparatus have a structure such that a color toner image is formed by the superposing of the constituent color toner images on a recording medium, the constituent color toner images formed by the respective toner forming units and sequentially transferred onto the recording medium.

To state it concretely, this image forming apparatus is equipped with an endless-belt-shaped recording medium conveying means (conveyance belt) 61, and near the periphery of this conveyance belt 61, there are arranged toner image forming units 20Y, 20M, 20C, and 20Bk for forming respective color toner images of yellow, magenta, cyan, and black in this order along the moving direction of a recording medium.

The exposure means 65 in each of the image forming units is composed of a linear light emitting device formed of a plurality of light emitting elements, each made up of, for example, a light emitting diode (LED), arrayed parallel to the rotational axis of the photoreceptor 21, and an image forming element having a magnification of 1 made up of a SELFOC lens for example, both mounted on a holder, is mounted on a cylindrical-shaped holder 66 as an exposure means holding member, and is integrally provided inside the substrate of the photoreceptor 21.

The conveyance belt 61 as a recording medium conveying means is an endless belt having a volume resistivity of $10^8$ Ω·cm to $10^{15}$ Ω·cm and a surface resistivity of $10^8$ Ω/square to $10^{15}$ Ω/square, and is a seamless belt having a two-layer structure composed of a semiconductive film base with a thickness of 0.1 mm to 0.5 mm made of, for example, an engineering plastic material such as modified polyimide, thermosetting polyimide, ethylene-tetrafluoroethylene copolymer, polyvinylidene fluoride, and nylon alloy having particles of a conductive material dispersed in it, and a desirably coated layer of a fluorine-contained resin on the outside as a toner filming preventing layer. For the base of the conveyance belt 61, other than the above-mentioned one, a semiconductive rubber belt with a thickness of 0.5 mm to 2.0 mm made of a silicone rubber or a urethane rubber having particles of a conductive material dispersed in it can be used. The conveyance belt 61 is trained about a drive roller 61*a*, a driven roller 61*b*, a backup roller 61*c*, and a tension roller 61*d*.

In addition, up to now, cases where this invention is applied to a color image forming apparatus have been explained, but this invention can be applied to a monochromatic image forming apparatus.

EXAMPLE

In the following, examples of practice of this invention will be explained, but this invention is not to be limited to these examples.

According to the structure shown in FIG. 1, a digital copying machine is manufactured. The concrete structure of the toner image forming unit pertinent to any one of the colors is such one as shown below.

(1) Photoreceptor:

For the photoreceptor, it was used an organic photoreceptor having a photosensitive layer with a thickness of 25 μm made of a polycarbonate resin containing a phthalocyanine pigment formed on the outer circumferential surface of a drum-shaped metallic substrate made of aluminum having an outer diameter of 60 mm and a thickness of 1 mm, with the peripheral speed set at 180 mm/s.

(2) Charging Means:

For the charging means, a scorotron charging device was used.

(3) Developing Means:

For the developing device, one provided with a developing sleeve having an outer diameter of 25 mm and being driven to rotate capable of carrying out two-component development with the developing sleeve having a bias voltage of the same polarity as the surface potential of the photoreceptor applied was used, and the carrying amount of the developer by the developing sleeve was set at 80 mg/cm$^2$. The maximum development width of the developing device which is substantially equal to the length in the lengthwise (L) direction of the useless toner image was 300 mm, which was shorter than the maximum image exposure width by 20 mm.

For the toner, one having a negative charging characteristic (charge quantity per unit mass: −55 μC/g) composed of toner particles produced by an emulsion polymerization method, having a volume-average particle diameter of 4.5 μm, a globurizing level of 0.95, and a CV value of 20% was used; for the carrier, a ferrite carrier composed of carrier particles with their surface coated with a styrene-methacrylate copolymer resin having a volume-average particle diameter of 45 μm was used, and a two-component developer having a toner concentration of 9% was prepared.

(4) Photoreceptor Cleaning Means and Intermediate Transfer Member Cleaning Means:

For each of the photoreceptor cleaning means and the intermediate transfer member cleaning means, one of a blade cleaning type was used.

For the photoreceptor cleaning blade, one having a hardness of 70° (JIS A hardness) and a thickness of 2.00 mm made of a urethane rubber was used, the pressing contact angle with the photoreceptor surface was set at 10°, and the pressing force was set at 0.18 N/cm.

For the intermediate transfer member cleaning blade, one having a hardness of 70° (JIS A hardness) and a thickness of 2.00 mm made of a urethane rubber was used, the pressing contact angle with the photoreceptor surface was set at 10°, and the pressing force was set at 0.18 N/cm.

<Inventive Sample 1>

By means of the above-mentioned digital copying machine, with the surface potential of the photoreceptor in the non-exposed area (Vh) set at −750 V, the surface potential of the photoreceptor in the exposed area (Vl) at −100 V, the development bias voltage to be applied to the developing sleeve at −600 V, and the ratio Vs/Vp of the peripheral speed of the developing sleeve Vs to the peripheral speed of the photoreceptor Vp controlled to be 2.5, the set maximum development toner quantity to be supplied for the development of an electrostatic latent image formed on the photoreceptor was set at 0.50 mg/cm$^2$, and through the practicing of the copy running test with the process control of (1) and (2) described below applied to it, the evaluation concerning whether or not the slipping through of toner particles did occur was carried out. The result is shown in Table 1 noted below. The copy running test was carried out in a low-temperature and low-humidity environment (at a temperature of 10° C., and a relative humidity of 20%). Further, the charge density of the toner particles making up the useless toner image on the photoreceptor (μC/g) was a value obtained by the above-mentioned method of measurement in which toner particles deposited on the photoreceptor were directly sucked by a suction means to be captured in a conductive toner capturing container, and the charge quantity was measured by an electrometer connected to this container.

The evaluation of the slipping-through of toner particles was made by a visual observation of the presence or absence of the generation of image smudging caused by the slipping-through of toner particles.

(Reference of Evaluation)

A: Image smudging is not recognized; further, even in the case where the process speed is set at 300 mm/s or higher, image smudging is not recognized.

B: Image smudging is not recognized.

C: Slight image smudging is recognized.

D: Image smudging is recognized and the image cannot be provided for actual use.

(Method of Control)

(1) In FIG. 3, let the region between Pr11 and Pc1 be 10 mm, the region between Pc1 and Pv1 20 mm, the region between Pr11 and Pr12 40 mm, the region between Pr12 and the leading edge position of the print area 50 mm, the region between the trailing edge of the print area and Pr21 50 mm, the region between Pr21 and Pc2 5 mm, the region between Pc2 and Pv2 5 mm, and the region between Pr21 and Pr22 40 mm.

(2) According to FIG. 6, at the timing when the place located at the downmost stream position in the charging voltage application region at the starting time of the application of the charging voltage reaches the developing region, the application of the development bias voltage to the developing sleeve is started, and at the timing when the place located at the uppermost stream position in the charging voltage application region at the stopping time of the application of the charging voltage reaches the developing region, the application of the development bias voltage is stopped.

−100 V, the development bias voltage to be applied to the developing sleeve set at −600 V, and the set maximum development toner quantity to be supplied for the development of an electrostatic latent image formed on the photoreceptor set at 0.52 mg/cm$^2$, with the starting and stopping of the application of the charging voltage as well as the starting and stopping of the application of the development bias voltage carried out according to the method of control (2) in the Inventive sample 1, and with the peripheral speed of the developing sleeve changed in accordance with Table 2 noted below during the formation of the useless toner image at the starting time and the ending time of an image formation sequence. The result is shown in Table 2 noted below. The copy running test was carried out in a low-temperature and low-humidity environment (temperature: 10° C., relative humidity: 20%). As regards the duration of the formation of the useless toner image in this example, at the starting time of an image formation sequence, it was the period from the timing when the place located at the downmost stream position in the charging voltage application region at the starting time of the application of the charging voltage (Pb1) reaches the developing region to the timing when the place located at the 30 mm upstream position of said place with respect to the rotating direction of the photoreceptor reaches the developing region (t1=30 mm), and at the ending time of an image formation sequence, it was the period from the timing when the place located, with respect to the rotating direction of the photoreceptor, at the 30 mm downstream position of the place located at the uppermost stream position in the charging voltage application region at the stopping time of the charging voltage (Pb2) reaches the developing region to the timing when the place located at the downmost stream position in the charging voltage application region at the stopping time of the charging voltage (Pb2) reaches the developing region (t2=30 mm).

TABLE 1

| | Method of control of charging voltage and development bias voltage at their rising time or falling time | $\frac{Vs}{Vp}$ | Maximum development toner quality (mg/cm$^2$) | Width of toner stripe (cm) | Toner quality per unit length of toner stripe (mg/cm) | Toner quality per one toner stripe (mg) |
|---|---|---|---|---|---|---|
| During development of image area | — | 2.5 | 0.50 | — | — | — |
| During development (FIG. 6) of toner stripe | Method (1) | 2.5 | 0.50 | 3.0 | 1.5 | 45.0 |
| During development (FIG. 3) of toner stripe | Method (2) | 2.5 | 0.50 | 1.3 | 0.65 | 19.5 |
| During development (FIG. 3) of toner stripe | Method (2) | 2.5 | 0.50 | 0.3 | 0.15 | 4.5 |

| | Charge density of toner particles on photoreceptor before cleaning (absolute value) (μC/g) | Total toner charge per unit length of toner stripe on photoreceptor before cleaning (μC/cm) | Total toner charge per one toner stripe on photoreceptor before cleaning (μC) | Whether or not slipping-through of toner particles did occur on photoreceptor |
|---|---|---|---|---|
| During development of image area | — | — | — | — |
| During development of toner stripe | 55 | 0.0825 | 0.0825xL | D |
| During development of toner stripe | 55 | 0.0358 | 0.0358xL | B |
| During development of toner stripe | 55 | 0.0083 | 0.0083xL | A |

As shown in the above, by an image forming apparatus of this invention in which an image formation sequence was carried out on the basis of the method of control (1), it was confirmed that an image having a high image quality was formed without generation of image smudging caused by the slipping-through of toner particles, and the expected cleaning effect by the cleaning means could be exhibited with certainty.

<Inventive Sample 2>

The evaluation concerning whether or not the slipping-through of toner particles did occur was carried out on the basis of the above-mentioned reference of evaluation, through the practicing of the copy running test, under a condition such that the surface potential of the photoreceptor in the non-exposed area (Vh) was set at −750 V, the surface potential of the photoreceptor in the exposed area (Vl) set at

TABLE 2

| | $\frac{Vs}{Vp}$ | Maximum development toner quantity (mg/cm$^2$) | Width of toner stripe (cm) | Toner quantity per unit length of toner stripe (mg/cm) | Charge density of toner particles on photoreceptor before cleaning (absolute value ($\mu$C/g) |
|---|---|---|---|---|---|
| During development of image area | 3.2 | 0.52 | — | — | — |
| During development of toner stripe | 1.8 | 0.34 | 2.8 | 0.952 | 55 |
| During development of toner stripe | 0.7 | 0.18 | 2.8 | 0.504 | 55 |

| | Total toner charge per unit length of toner stripe on photoreceptor before cleaning ($\mu$C/cm) | Total toner charge per one toner stripe on photoreceptor before cleaning ($\mu$C) | Whether or not slipping-through of toner particles did occur on photoreceptor |
|---|---|---|---|
| During development of image area | — | — | — |
| During development of toner stripe | 0.0524 | 0.524L | D |
| During development of toner stripe | 0.0277 | 0.0277L | B |

As shown in the above, it was confirmed that, in the case where the total charge quantity of the toner particles making up the toner stripe is made to be 0.04L ($\mu$C) or less, by the practicing of the control of the peripheral speed of the developing sleeve, at the starting time and the ending time of an image formation sequence, to reduce the maximum development toner quantity from the set maximum development toner quantity to 0.3 mg/cm$^2$ by a decrement of 0.1 mg/cm$^2$ or more, an image having a high image quality was formed without generation of image smudging caused by the slipping-through of toner particles, and the expected cleaning effect by the cleaning means could be exhibited with certainty.

<Inventive Sample 3>

Through the practicing of a copy running test which was the same as the Inventive sample 2 except that the ratio Vs/Vp of the peripheral speed of the developing sleeve Vs to the peripheral speed of the photoreceptor Vp is fixedly set at 3.2 to make the set maximum development toner quantity to be supplied for the development of an electrostatic latent image formed on the photoreceptor 0.52 mg/cm$^2$, while, at the time of forming the useless toner image inevitably produced at the starting time and the ending time of an image formation sequence, instead of changing the peripheral speed of the developing sleeve, it was practiced a control so as to transfer substantially all the toner particles making up the toner stripe to the intermediate transfer belt, the evaluation concerning whether or not the slipping-through of toner particles did occur on the photoreceptor and on the intermediate transfer member was made. The result is shown in Table 3 noted below.

<Comparative Sample 1>

A copy running test which was the same as the Inventive sample 3 except that the toner particles deposited on the useless toner image forming area on the photoreceptor were not transferred to the intermediate transfer member was carried out, and the evaluation concerning whether or not the slipping-through of toner particles did occur on the photoreceptor and on the intermediate transfer member was made. The result is shown in Table 3 noted below.

TABLE 3

| | Whether or not transfer of toner stripe to intermediate transfer belt was done | $\frac{Vs}{Vp}$ | Maximum development toner quantity (mg/cm$^2$) | Width of toner stripe (cm) | Toner quantity per unit length of toner stripe (mg/cm) | Charge density of toner particles on photoreceptors before cleaning (absolute value ($\mu$C/g) |
|---|---|---|---|---|---|---|
| During development of image area | — | 3.2 | 0.52 | — | — | — |
| Inventive sample 3 | Yes | 3.2 | 0.52 | 2.8 | 0.112 | 45 |
| Comparative sample 1 | No | 3.2 | 0.52 | 2.8 | 1.456 | 55 |

TABLE 3-continued

| | Total toner charge per unit length of toner stripe on photoreceptor before cleaning (μC/m) | Total toner charge per one toner stripe on photoreceptor before cleaning (μC) | Whether or not slipping-through of toner particles did occur on photoreceptor | Whether or not slipping-through of toner particles did occur on intermediate tranfer belt |
|---|---|---|---|---|
| During development of image area | — | — | — | — |
| Inventive sample 3 | 0.0050 | 0.0050L | A | B |
| Comparative sample 1 | 0.0801 | 0.0801L | D | B |

It was confirmed that, in the case where the toner stripe formed in the useless toner image forming area at the starting time and the ending time of an image formation sequence was transferred to the intermediate transfer belt, an image having a high image quality was formed without the occurrence of the slipping-through of toner particles on both of the photoreceptor and the intermediate transfer member, and the expected cleaning effect by the cleaning means could be exhibited with certainty.

<Inventive Sample 4>

It was carried out a copy running test which was the same as the Inventive sample 3 except that the set maximum development toner quantity to be supplied for the development of an electrostatic latent image formed on the photoreceptor was determined to be 0.65 mg/cm$^2$, and by the control of the peripheral speed of the developing sleeve, without the peripheral speed of the photoreceptor being changed, during the useless toner image forming time to make the maximum development toner quantity 0.27 mg/cm$^2$ (Vs/Vp=1.3), the total charge quantity of the toner particles making up the useless toner image was made to be 0.04L μC or less, and it was made the evaluation concerning whether or not the slipping-through of toner particles did occur on the photoreceptor and on the intermediate transfer member. The result is shown in Table 4 noted below.

<Comparative Sample 2>

It was carried out a copy running test which was the same as the Inventive sample 4 except that the toner particles deposited on the useless toner image forming area on the photoreceptor were not transferred onto the intermediate transfer member, and it was made the evaluation concerning whether or not the slipping-through of toner particles did occur on the photoreceptor and/or on the intermediate transfer member. The result is shown in Table 4 noted below.

<Comparative Sample 3>

It was carried out a copy running test which was the same as the Inventive sample 4 except that, in addition to the peripheral speed of the developing sleeve being not controlled during the useless toner forming time, the toner particles deposited on the useless toner image forming area on the photoreceptor were not transferred onto the intermediate transfer member, and it was made the evaluation concerning whether or not the slipping-through of toner particles did occur on the photoreceptor and/or on the intermediate transfer member. The result is shown in Table 4 noted below.

TABLE 4

| | Whether or not transfer of toner stripe to intermediate transfer belt was done | $\frac{Vs}{Vp}$ | Maximum development toner quantity (mg/cm$^2$) | | Width of toner stripe (cm) | Toner quantity per unit length of toner stripe (mg/cm) | Charge density of toner particles on photoreceptor before cleaning (absolute value (μC/g) |
|---|---|---|---|---|---|---|---|
| During development of image area | — | 3.2 | 0.65 | — | — | — | — |
| Inventive sample 4 | Yes | 1.3 | 0.27 | 0.02 | 2.8 | 0.056 | 45 |
| Comparative sample 2 | No | 1.3 | 0.27 | 0.27 | 2.8 | 0.756 | 55 |
| Comparative sample 3 | No | 3.2 | 0.65 | 0.65 | 2.8 | 1.82 | 55 |

| | Total toner charge per unit length of toner stripe on photoreceptor before cleaning (μC/m) | Total toner charge per one toner stripe on photoreceptor before cleaning (μC) | Whether or not slipping-through of toner particles did occur on photoreceptor | Whether or not slipping-through of toner particles did occur on intermediate tranfer belt |
|---|---|---|---|---|
| During development of image area | — | — | — | — |
| Inventive sample 4 | 0.0025 | 0.0025xL | A | B |
| Comparative sample 2 | 0.0416 | 0.0416xL | C | B |
| Comparative sample 3 | 0.1001 | 0.1001xL | D | B |

As shown in the above, it was confirmed that, even in the case where the set maximum development toner quantity during the image area developing time was set at a value larger than 0.6 mg/cm$^2$, in the case where the maximum development toner quantity was reduced to a half of the set maximum development toner quantity during the image area developing time or less by the control of the peripheral speed of the developing sleeve during the useless toner image forming time at the starting time and the ending time of an image formation sequence, and the toner stripe formed in the useless toner image forming area at the starting time and the ending time of an image formation sequence was transferred to the intermediate transfer belt, an image having a high image quality was formed without the occurrence of the slipping-through of toner particles on both of the photoreceptor and the intermediate transfer member, and the expected cleaning effect by the cleaning means could be exhibited with certainty.

<Inventive Sample 5>

A digital copying machine having the same structure as the above-mentioned one except that each of the toner image forming units is made up according to FIG. 7 was used. For the toner charge reducing means, a corona discharging device was used, and to the discharging electrode of the corona discharging device, it was connected an alternate-current power source for applying an alternate-current discharging voltage with its magnitude controlled.

Further, through the practicing of a copy running test under a condition such that the surface potential of the photoreceptor in the non-exposed area (Vh) was set at −750 V, the surface potential of the photoreceptor in the exposed area (Vl) set at −100 V, the development bias voltage to be applied to the developing sleeve set at −600 V, and the set maximum development toner quantity to be supplied for the development of an electrostatic latent image formed on the photoreceptor set at 0.45 mg/cm$^2$, with the starting and stopping of the application of the charging voltage as well as the starting and stopping of the application of the development bias voltage carried out according to the method of control (2) in the Inventive sample 1, and with the alternate-current discharging voltage applied to the toner charge reducing means controlled in accordance with Table 5 noted below during the formation of the useless toner image at the starting time and the ending time of an image formation sequence, the evaluation concerning whether or not the slipping-through of toner particles did occur was made.

TABLE 5

| | AC effective value of voltage applied to charge reducing means for toner stripe | $\frac{Vs}{Vp}$ | Maximum development toner quantity (mg/cm$^2$) | Width of toner stripe (cm) | Toner quantity per unit unit length of toner stripe (mg/cm) |
|---|---|---|---|---|---|
| During development of image area | — | 2.5 | 0.45 | — | — |
| During development of toner stripe | 0.0 | 2.5 | 0.45 | 2.8 | 1.26 |
| During development of toner stripe | 2.0 | 2.5 | 0.45 | 2.8 | 1.26 |
| During development of toner stripe | 3.0 | 2.5 | 0.45 | 2.8 | 1.26 |
| During development of toner stripe | 4.0 | 2.5 | 0.45 | 2.8 | 1.26 |

| | Charge density of toner particles on photoreceptor before cleaning (absolute value) ($\mu$C/g) | Total toner charge per unit length of toner stripe on photoreceptor before cleaning ($\mu$C/cm) | Total toner charge per one toner stripe on photoreceptor before cleaning ($\mu$C) | Whether or not slipping-through of toner particles did occur on photoreceptor |
|---|---|---|---|---|
| During development of image area | — | — | — | — |
| During development of toner stripe | 55 | 0.0693 | 0.0693L | D |
| During development of toner stripe | 40 | 0.0504 | 0.0504L | D |
| During development of toner stripe | 30 | 0.0378 | 0.0378L | B |
| During development of toner stripe | 20 | 0.0252 | 0.0252L | B |

As shown in the above, it was confirmed that, in the case where the total charge quantity of the toner particles making up the toner stripe is made to be 0.04L ($\mu$C) or less, by a charge eliminating electric field acting on the useless toner image forming area on the photoreceptor inevitably formed at the starting time and the ending time of an image formation sequence produced by the toner charge reducing means with an alternate-current discharging voltage applied, to reduce the total charge quantity of the toner particles making up the toner stripe on the photoreceptor to 35 $\mu$C/g (absolute value) or smaller, an image having a high image quality was formed without the generation of image smudging caused by the slipping-through of toner particles, and the expected cleaning effect by the cleaning means could be exhibited with certainty.

<Inventive Sample 6>

By the use of a digital copying machine having the same structure as that used in Inventive sample 5 except that a direct-current power source for applying a direct-current discharging voltage of the polarity reverse to the charge polarity of the toner with its magnitude controlled was connected to the discharging electrode of the corona discharging device as a toner charge reducing means, and through the practicing of a copy running test which was the same as the Inventive sample 5 except that the direct-current discharging voltage to be applied to the toner charge reducing means during the formation of the useless toner image at the starting time and the ending time of an image formation sequence was controlled in accordance with Table 6 noted below, the evaluation concerning whether or not the slipping-through of toner particles did occur was made. The result is shown in Table 6 noted below.

TABLE 6

| | DC voltage applied to charge reducing means for toner stripe | $\frac{Vs}{Vp}$ | Maximum development toner quantity (mg/cm$^2$) | Width of toner stripe (cm) | Toner quantity per unit length of toner stripe (mg/cm) |
|---|---|---|---|---|---|
| During development of image area | — | 2.5 | 0.45 | — | — |
| During development 0.0 of toner stripe | 2.5 | 0.45 | 2.8 | 1.26 | |
| During development of toner stripe | 2.0 | 2.5 | 0.45 | 2.8 | 1.26 |
| During development of toner stripe | 3.0 | 2.5 | 0.45 | 2.8 | 1.26 |
| During development of toner stripe | 4.0 | 2.5 | 0.45 | 2.8 | 1.26 |

| | Charge density of toner particles on photoreceptor before cleaning (absolute value ($\mu$C/g) | Total toner charge per unit length of toner stripe on photoreceptor before cleaning ($\mu$C/cm) | Total toner charge per one toner stripe on photoreceptor before cleaning ($\mu$C) | Whether or not slipping-through of toner particles did occur on photoreceptor |
|---|---|---|---|---|
| During development of image area | — | — | — | — |
| During development of toner stripe | 55 | 0.0693 | 0.0693L | D |
| During development of toner stripe | 40 | 0.0504 | 0.0504L | D |
| During development of toner stripe | 30 | 0.0378 | 0.0378L | B |
| During development of toner stripe | 20 | 0.0252 | 0.0252L | B |

As shown in the above, it was confirmed that, also in the case where the total charge quantity of the toner particles making up the toner stripe is made to be 0.04L ($\mu$C) or less, by a charge eliminating electric field acting on the useless toner image forming area on the photoreceptor inevitably formed at the starting time and the ending time of an image formation sequence produced by the toner charge reducing means with a direct-current discharging voltage of the polarity reverse to the charge polarity of the toner applied, to reduce the total charge quantity of the toner particles making up the toner stripe on the photoreceptor to 35 $\mu$C/g (absolute value) or smaller, an image having a high image quality was formed without the generation of image smudging caused by the slipping-through of toner particles, and the expected cleaning effect by the cleaning means could be exhibited with certainty.

By an image forming apparatus of this invention, by the total charge quantity of the toner particles making up the useless toner image, inevitably formed on the image forming member positively for the purpose of preventing the occurrence of carrier adhering to the image forming member at the starting time and the ending time of an image formation sequence, being made equal to or less than 0.04L ($\mu$C), the load given to the cleaning member in the image forming member cleaning means is reduced by a large margin; therefore, the expected cleaning effect can be exhibited with certainty, and the untransferred toner particles remaining on the image forming member can be removed with certainty; hence, an image having a high image quality can be obtained with certainty.

By the practice of the specified exposure processing carried out when an image formation sequence is started in which exposure by the exposure means for the image forming means is started before the application of the charging voltage and stopped immediately after the start of the application of the development bias voltage, compared to the useless toner image formed in the case where the start point on the photoreceptor of the application of the charging voltage is set in such a state as to substantially agree with the start point on the photoreceptor of the application of the development bias voltage, the width of the useless toner image can be made as small as possible; owing to this, a state in which the total charge quantity of the toner particles making up the useless toner image becomes equal to or less than 0.04L ($\mu$C) can be actualized with certainty.

Further, by the practice of the specified exposure processing carried out when an image formation sequence is finished in which exposure by the exposure means for the image forming means is started before the stopping of the application of the charging voltage and stopped immediately after the surface potential of the charged image forming member becomes zero, compared to the useless toner image formed in the case where the start point of on the photoreceptor of the application of the charging voltage is set in such a state as to substantially agree with the start point on the photoreceptor of the application of the development bias voltage, the width of the useless toner image can be made as small as possible; owing to this, a state in which the total charge quantity of the toner particles making up the useless toner image becomes equal to or less than 0.04L ($\mu$C) can be actualized with certainty.

Further, under a condition set in such a way that a useless toner image is formed on the image forming member positively for the purpose of preventing the occurrence of carrier adhering to the image forming member at the starting time and the ending time of an image forming sequence, by the control of the peripheral speed of the developer carrying member during the passage of the deficiently charged area on the image forming member on the developing region, to reduce the maximum development toner quantity from the maximum development toner quantity during the development of the image area to a specified value by a specified decrement, the quantity of the toner particles making up the useless toner image formed in the deficiently charged area of the image forming member is reduced to a small value not greater than a specified value; therefore, a state in which the total charge quantity of the toner particles making up the useless toner image is made equal to or less than 0.04L ($\mu$C) can be actualized with certainty.

Moreover, under a condition set in such a way that a useless toner image is formed on the image forming member positively for the purpose of preventing the occurrence of carrier adhering to the image forming member at least at one of the starting time and the ending time of an image formation sequence, by the transferring of a part or the whole of the toner particles making up the useless toner image formed on the deficiently charge area on the image forming member onto the intermediate transfer member, which reduces the quantity of the toner particles making up the useless toner image formed on the deficiently charged area of the image forming member to a small value not greater than a specified value; therefore, a state in which the total charge quantity of the toner particles making up the useless toner image becomes 0.04L ($\mu$C) or less can be actualized with certainty.

Further, under a condition in which the operation of the toner image forming unit is set in such a way that a useless toner image is formed on the image forming member positively for the purpose of preventing the occurrence of carrier adhering to the image forming member at the starting time and the ending time of an image formation sequence, by a charge eliminating electric field being made to act on the deficiently charged area on the image forming member produced by the toner quantity reducing means with an alternate-current voltage or a direct-current voltage of the polarity reverse to the charge polarity of the toner applied, to reduce the charge quantity of the toner particles making up the useless toner image, a state in which the total charge quantity of the toner making up the useless toner image becomes 0.04L ($\mu$C) or less can be actualized with certainty.

What is claimed is:

1. An image forming apparatus comprising:

(a) a rotary image forming body;

(b) a charging device for charging a surface of the image forming body;

(c) an exposure device for imagewise exposing the surface of the image forming body to form an electrostatic latent image;

(d) a developing device for reverse-developing the electrostatic latent image to form a toner image through conveying a layer of two-component developer containing toner particles having a volume-average particle diameter of 3 $\mu$m to 5 $\mu$m to a developing region by a developer carrying body with a development bias applied, that is rotatably provided opposite to the image forming body through the developing region positioned between the image forming body and the developer carrying body;

(e) a transfer device for transferring the toner image formed on the image forming body onto a recording medium or onto an intermediate transfer body in a transfer region; and (f) a cleaning device for removing untransferred toner particles remaining on the image forming body which have passed the transfer region, by a cleaning member provided in pressure contact with the surface of the image forming body, wherein a total charge quantity of the toner particles forming a useless toner image is 0.04L $\mu$C or less where L denotes a length in a lengthwise direction of the useless toner image representing the untransferred toner particles remaining on the image forming body, formed on the image forming body at a starting time and an ending time of an image forming sequence.

2. The image forming apparatus of claim 1, wherein at the starting time of the image formation sequence, a specified exposure processing is carried out in which an exposure by the exposure device is started at the time when a first place on the image forming body located at a downmost stream position with respect to a rotating direction of the image forming body in a charging voltage application region on the image forming body facing the charging device at a starting time of an application of a charging voltage by the charging device reaches an exposure position by the exposure device, or before the first place reaches the exposure position, and the exposure by the exposure device is stopped at the time when a second place on the image forming body located at an uppermost stream position in the charging voltage application region at the starting time of the charging voltage application reaches the exposure position, or after the second place has passed the exposure position, and wherein a development bias voltage is applied to the developer carrying body at the time when the second place on a photoreceptor located at the exposure position at the stopping time of the exposure in the specified exposure processing reaches the developing region or before the second place reaches the developing region.

3. The image forming apparatus of claim 2, wherein the start of the application of the development bias voltage to the developer carrying body is carried out during a period of time before the time when the second place on the image forming body which is located at the exposure position at the exposure stopping time in the specified exposure processing reaches the developing region and after the time when a place located downstream by 15 mm of the second place with respect to the rotating direction of the image forming body reaches the developing region.

4. The image forming apparatus of claim 2, wherein the total quantity of the toner particles forming a stripe-shaped useless toner image formed on the image forming body is 25 mg or less.

5. The image forming apparatus of claim 2, wherein the stopping of the exposure in the specified exposure processing is carried out, between the time when the second place on the image forming body located at the uppermost stream position in the charging voltage application region at the starting time of the charging voltage application reaches the exposure position, and the time when a place located, with respect to the moving direction of the image forming body, at the 20 mm or more downstream position of the leading edge position of a beginning image region located at the upstream side of the second place with respect to the rotating direction of the image forming body reaches the exposure position.

6. The image forming apparatus of claim 1, wherein the toner particles removed from the image forming body by the image forming body cleaning device are utilized again.

7. The image forming apparatus of claim 1, wherein at the ending time of the image formation sequence, a specified exposure processing is carried out in which an exposure by the exposure device is started at the time when a first place on the image forming body located at a downmost stream position with respect to a rotating direction of the image forming body in a charging voltage application region on the image forming body facing the charging device at the starting time of an application of a charging voltage by the charging device reaches an exposure position by the exposure device, or before the first place reaches the exposure position, and the exposure by the exposure device is stopped at the time when a second place on the image forming body located at an uppermost stream position in the charging voltage application region at the starting time of the charging voltage application reaches the exposure position or after the second place has passed the exposure position, and wherein a development bias voltage is applied to the developer carrying body at the time when the first place on the photoreceptor located at the exposure position at the stopping time of the exposure in the specified exposure processing reaches the developing region or after the first place has passed the developing region.

8. The image forming apparatus of claim 7, wherein the stop of the application of the development bias voltage to the developer carrying body is carried out between the time when the first place on the image forming body located at the exposure position at the exposure starting time in the specified exposure processing reaches the developing region and the time when a place located upstream by 15 mm of the first place with respect to the rotating direction of the image forming body reaches the developing region.

9. The image forming apparatus of claim 7, wherein the total quantity of toner forming a stripe-shaped useless toner image formed on the image forming body is 25 mg or less.

10. The image forming apparatus of claim 7, wherein the exposure starting in the specified exposure processing is carried out between the time when the first place located, with respect to the moving direction of the image forming body, at the 20 mm or more upstream position of the trailing edge position of an end image area reaches the exposure position and the time when a place on the image forming body located at the downmost stream position in the charging voltage application region at the stopping time of the charging voltage application reaches the exposure position.

11. The image forming apparatus of claim 7, wherein the toner particles removed from the image forming body by the image forming body cleaning device are utilized again.

12. The image forming apparatus of claim 1, wherein at the starting time and the ending time of the image formation sequence, a development bias voltage is made to act on deficiently charged areas of the image forming body which are caused by a starting and ending operations of a voltage application by the charging device, while a peripheral speed of the developer carrying body is controlled, and at least at one of the starting time and the ending time of the image formation sequence, in the deficiently charged areas on the image forming body passing the developing region with a development bias voltage made to act thereon, the peripheral speed of the developer carrying body is controlled in such a way that a maximum developer toner quantity is reduced from a set maximum development toner quantity to be supplied for the development of the electrostatic latent image to become 0.3 mg/cm$^2$ or less.

13. The image forming apparatus of claim 1, further comprising:

a secondary transfer device for forming a secondary transfer toner image through transferring a primary transfer toner image formed on the intermediate transfer body onto an image recording medium in a secondary transfer region; and an intermediate transfer body cleaning device for removing untransferred toner particles remaining on the intermediate transfer body having passed the secondary transfer region by a cleaning member provided in pressure contact with a surface of the intermediate transfer body, wherein at the starting time and the ending time of an image formation sequence, a development bias voltage is made to act on deficiently charged areas on the image forming body, which are caused by a starting and ending operations of a voltage application by the charging device, and at least at one of the starting time and the ending time of an image formation sequence, a part or the whole of the toner particles making up a useless toner image formed in the deficiently charged areas on the image forming body passing the developing region with a development bias voltage made to act thereon are transferred to the intermediate transfer body, to be removed from the intermediate transfer body.

14. The image forming apparatus of claim 1, wherein at the starting time and the ending time of an image formation sequence, a development bias voltage is made to act on the deficiently charged areas of the image forming body, which are caused by a starting and ending operations of a voltage application by the charging device, and the image forming apparatus further comprises a toner charge quantity reducing device for reducing a charge quantity of undeveloped toner particles on the image forming body by an application of an alternate-current discharging voltage provided at an upstream position of the cleaning region by the image forming body cleaning device with respect to the rotating direction of the image forming body, at least at one of the starting time and the ending time of an image formation sequence, on the deficiently charged area of the image forming body passing the developing region with a development bias voltage made to act thereon, an electric field for charge elimination is made to act.

15. The image forming apparatus of claim 14, wherein the toner charge quantity reducing device reduces an absolute value of an average charge quantity of the untransferred toner particles on the image forming body to 35 $\mu$C/g or less.

16. The image forming apparatus of claim 1, wherein at the starting time and the ending time of an image formation sequence, a development bias voltage is made to act on the deficiently charged areas of the image forming body, which are caused by a starting and ending operations of a voltage application by the charging device, and wherein the image forming apparatus further comprises a toner charge quantity reducing device for reducing a charge quantity of undeveloped toner particles on the image forming body by an application of a direct-current discharging voltage of a polarity reverse to a charge polarity of the toner, with respect to a rotating direction of the image forming body, at an upstream position of the cleaning region by the image forming body cleaning device, and at least at one of the starting time and the ending time of an image formation sequence, on the deficiently charged area of the image forming body passing the developing region with a development bias voltage made to act thereon, and an electric field for charge elimination is made to act.

17. The image forming apparatus of claim 16, wherein the toner charge quantity reducing device reduces an absolute value of an average charge quantity of the untransferred toner particles on the image forming body to 35 3 $\mu$C/g or less.

* * * * *